US011155453B2

(12) United States Patent
Cacciatore et al.

(10) Patent No.: US 11,155,453 B2
(45) Date of Patent: Oct. 26, 2021

(54) CONTAINER FILLING ASSEMBLY

(71) Applicant: The Procter & Gamble Company, Cincinnati, OH (US)

(72) Inventors: Justin Thomas Cacciatore, Cincinnati, OH (US); Eric Shawn Goudy, Liberty Township, OH (US); Bernard George Durham, Mason, OH (US); Benny Leung, Wyoming, OH (US); John Glenn Kuley, Cincinnati, OH (US); Scott William Capeci, North Bend, OH (US); Vincenzo Guida, Saint Pierre (BE); Emilio Javier Tozzi, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 22 days.

(21) Appl. No.: 16/002,532

(22) Filed: Jun. 7, 2018

(65) Prior Publication Data

US 2018/0354770 A1 Dec. 13, 2018

Related U.S. Application Data

(60) Provisional application No. 62/516,965, filed on Jun. 8, 2017.

(51) Int. Cl.

| | |
|---|---|
| ***B67C 3/28*** | (2006.01) |
| ***B67C 3/24*** | (2006.01) |
| ***B67C 3/20*** | (2006.01) |
| ***B67C 3/02*** | (2006.01) |
| ***B65B 3/26*** | (2006.01) |

(Continued)

(52) U.S. Cl.

CPC ..... *B67C 3/286* (2013.01); *B65B 3/26* (2013.01); *B65B 3/326* (2013.01); *B65B 59/001* (2019.05); *B67C 3/023* (2013.01); *B67C 3/206* (2013.01); *B67C 3/208* (2013.01); *B67C 3/24* (2013.01); *B65B 2039/009* (2013.01)

(58) Field of Classification Search

None

See application file for complete search history.

(56) References Cited

U.S. PATENT DOCUMENTS 2,669,946 A 2/1954 Peyton
2,848,579 A * 8/1958 Russell ..... H01H 51/2236 335/84

(Continued)

FOREIGN PATENT DOCUMENTS

CN 204210760 U 3/2015
DE 102005031682 A1 1/2007

(Continued)

OTHER PUBLICATIONS

Machine Translation of EP2848579 retrieved 2019. (Year: 2014).*

(Continued)

*Primary Examiner* — Jessica Cahill
*Assistant Examiner* — Christopher M Afful
(74) *Attorney, Agent, or Firm* — Andrés E. Velarde

(57) ABSTRACT

A container filling assembly that can be used with container filling systems to fill containers during successive filling cycles with the same or different fluid compositions at high rates of speed, with little to no machinery changeover, and/or with little to no fluid waste.

9 Claims, 18 Drawing Sheets

(51) Int. Cl.

| | |
|---|---|
| ***B65B 3/32*** | (2006.01) |
| ***B65B 59/00*** | (2006.01) |
| ***B65B 39/00*** | (2006.01) |

(56) References Cited

U.S. PATENT DOCUMENTS

| | | | | |
|---|---|---|---|---|
| 2,927,781 | A | 3/1960 | Fohrhaltz et al. | |
| 2,986,915 | A | 6/1961 | Nau | |
| 3,128,994 | A | 4/1964 | Hungate | |
| 3,631,818 | A * | 1/1972 | Zito | A21C 9/04 99/450.1 |
| 3,877,682 | A * | 4/1975 | Moss | B01F 15/0441 366/132 |
| 3,913,801 | A | 10/1975 | Wise et al. | |
| 3,960,295 | A * | 6/1976 | Horak | B01F 15/0441 222/145.6 |
| 4,676,279 | A | 6/1987 | Von Lersner | |
| 5,353,958 | A | 10/1994 | Hawkins | |
| 5,547,725 | A | 8/1996 | Barrows et al. | |
| 5,590,976 | A | 1/1997 | Kilheffer et al. | |
| 5,899,244 | A | 5/1999 | Nish et al. | |
| 5,964,378 | A * | 10/1999 | Sperry | B29B 7/7678 141/105 |
| 5,967,367 | A | 10/1999 | Orsborn | |
| 7,000,656 | B2 | 2/2006 | Todd | |
| 7,048,148 | B2 | 5/2006 | Roekens et al. | |
| 7,690,405 | B2 | 4/2010 | Miller et al. | |
| 7,958,910 | B2 | 6/2011 | Nakamori et al. | |
| 8,240,908 | B2 | 8/2012 | Williams et al. | |
| 8,602,633 | B2 | 12/2013 | McLaughlin et al. | |
| 8,616,760 | B2 | 12/2013 | Williams et al. | |
| 8,616,761 | B2 | 12/2013 | McLaughlin et al. | |
| 9,415,992 | B2 | 8/2016 | Ryan et al. | |
| 9,720,425 | B2 | 8/2017 | Goudy et al. | |
| 2001/0031718 | A1 | 10/2001 | Kaess | |
| 2002/0056721 | A1 | 5/2002 | Phillips et al. | |
| 2004/0026463 | A1 | 2/2004 | Airaksinen | |
| 2004/0219269 | A1 | 11/2004 | Cathenaut et al. | |
| 2007/0044824 | A1 | 3/2007 | Capeci et al. | |
| 2007/0114244 | A1 | 5/2007 | Gatipon et al. | |
| 2007/0205220 | A1 | 9/2007 | Rudick et al. | |
| 2008/0031085 | A1 | 2/2008 | McLaughlin et al. | |
| 2009/0014464 | A1 | 1/2009 | Adbelmoteleb et al. | |
| 2010/0237099 | A1 | 9/2010 | Carpenter et al. | |
| 2011/0214779 | A1 | 9/2011 | Goldman et al. | |
| 2011/0264284 | A1 | 10/2011 | Rudick et al. | |
| 2012/0230148 | A1 | 9/2012 | van Opstal et al. | |
| 2014/0150670 | A1 | 6/2014 | Green et al. | |
| 2014/0153391 | A1 | 6/2014 | Ludwig et al. | |
| 2014/0263413 | A1 | 9/2014 | Green | |
| 2015/0374609 | A1 | 12/2015 | Cetti et al. | |
| 2017/0102720 | A1 | 4/2017 | Goudy et al. | |
| 2018/0354767 | A1 | 12/2018 | Cacciatore et al. | |
| 2018/0354769 | A1 | 12/2018 | Cacciatore et al. | |

FOREIGN PATENT DOCUMENTS

| | | | | |
|---|---|---|---|---|
| EP | 2848579 | A1 * | 3/2015 | B67C 3/206 |
| GB | 2231624 | A | 11/1990 | |
| GN | 202107096 | U | 1/2012 | |
| JP | H03240627 | A | 10/1991 | |
| JP | H0539224 | A | 2/1993 | |
| JP | 2006188276 | A | 7/2006 | |
| JP | 2008110803 | A | 5/2008 | |
| WO | WO03/097516 | A1 | 11/2003 | |
| WO | WO2013176921 | A1 | 11/2013 | |
| WO | WO2014197618 | A3 | 2/2015 | |
| WO | WO2017060453 | A1 | 4/2017 | |

OTHER PUBLICATIONS

EP-2848579-A1—English Translation (Year: 2015).*

International Search Report for International Application Serial No. PCT/US2018/036421, dated Sep. 25, 2018, 13 pages.

Ober, et al. "Active Mixing of Complex Fluids at the Microscale", Proceedings of the National Academy of Sciences of the United States of America, Oct. 6, 2015; 112(40): 12293-12298, published online Sep. 22, 2015. doi: 10.1073/pnas.1509224112 https://www.ncbi.nlm.nih.gov/pmc/articles/PMC4603479/#eqs1.

* cited by examiner

CONTAINER FILLING ASSEMBLY

FIELD OF THE INVENTION

This disclosure is directed to an improved container filling assembly used with systems to fill containers with compositions at high rates of speed.

BACKGROUND OF THE INVENTION

High speed container filling assemblies are well known and used in many different industries, such as, for example in the hand dish soap industry and in the liquid laundry detergent industry. In many of the assemblies, fluid products are supplied to containers to be filled through a series of pumps, pressurized tanks and flow meters, fluid filling nozzles, and/or valves to help ensure the correct amount of fluid is dispensed into the containers. These fluid products may be composed of an array of different materials, including viscous fluids, particle suspensions, and other materials that may be desired to be blended or mixed into a final product. These materials may require the addition or removal of energy to enable mixing of the materials, to create emulsions, and the like. As such, the container filling assemblies may provide for the materials to flow at a certain rate of flow to enable such mixing of the materials into a fluid composition, known as the rate of mixing. The rate of mixing should be high enough to enable mixing and other such transformations as too low of a rate of mixing could lead to an insufficient supply of mixed fluid product or poorly mixed fluid product. The rate at which the fluid product is dispensed out of the assembly, typically through a nozzle, and into the container, typically through an opening in the container, is known as the rate of dispensing. Too high a rate of dispensing may create a surge of product at the end of the dispensing of the product into the container that can cause the fluid in the container to splash in a direction generally opposite to the direction of filling and often out of the container being filled. This can lead to a waste of the fluid, contamination of the outer surfaces of the container and/or contamination of the filling equipment itself.

A problem occurs when the predicted rate of mixing is higher than the rate of dispensing into the containers. To compensate for this scenario, the parts of the assembly where the fluid is mixed and the parts of the assembly where fluid is dispensed are respectively scaled to the size needed such that the mass rate of flow of fluid from one part of the assembly to the other is similar, or close to a 1:1 ratio, such that fluid flows at a steady-state flow.

In scaling the different machine parts to enable a steady-state flow of fluid throughout the assembly, the assemblies are many times configured to only fill one type of container with one type of product composed of one or more fluids. A problem arises when a different container type and/or different fluid product is desired from the assembly. In this situation, the configuration of the assembly must be changed (e.g., different nozzles, different carrier systems, etc.) and the chambers and pipes used must be cleansed or primed with a new product, which can be time consuming, costly, can result in increased downtimes, and is wasteful of fluid resources.

To provide consumers with a diverse product line, a manufacturer must employ many different high speed container assemblies which can be expensive and space intensive or must accept accrued changeover time between filling cycles when switching compositions and accept having more waste product. Accordingly, it would be desirable to provide a container filling assembly capable of filling containers with fluid products at high speeds while not having to manage scaling difficulties driven by the rate of mixing; not having to change machinery to allow for different quantities and different types of fluid composition; not having time-consuming changeover periods in between filling cycles; and not being as wasteful of materials and resources in between filling cycles.

SUMMARY OF THE INVENTION

A container filling assembly for a fluid filling operation, the assembly comprising: a temporary storage chamber, a mixing chamber located upstream of and in fluid communication with the temporary storage chamber and a dispensing chamber located downstream of and in fluid communication with the temporary storage chamber. The assembly further comprises a first valve in fluid communication with the mixing chamber and with the temporary storage chamber and a second valve in fluid communication with the temporary storage chamber and with the dispensing chamber. The assembly further comprising a fluid composition comprising at least a first material and a second material different than the first material, wherein at least a portion of the fluid composition is formed within the mixing chamber. The assembly further comprising a piston pump located at least partially within the temporary storage chamber and/or one or more air pumps in fluid communication with the temporary storage chamber.

DETAILED DESCRIPTION OF THE INVENTION

Figure 1:
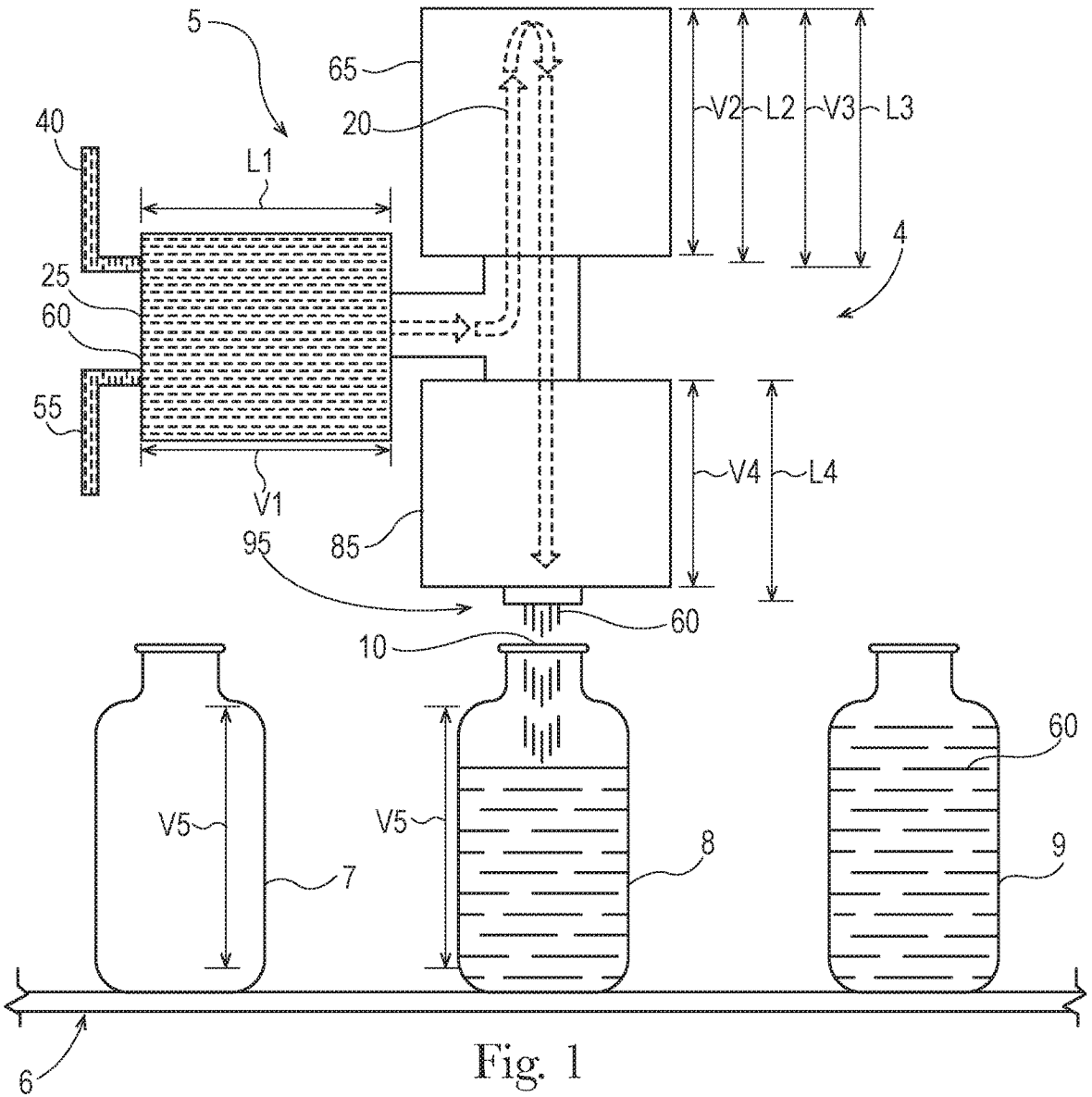
FIG. 1 is an elevation view of a container filling operation having a container filling assembly.

The following description is intended to provide a general description of the invention along with specific examples to help the reader. The description should not be taken as limiting in any way as other features, combinations of features and embodiments are contemplated by the inventors. Further, the particular embodiments set forth herein are intended to be exemplary of the various features of the invention. As such, it is fully contemplated that features of any of the embodiments described can be combined with or replaced by features of other embodiments, or removed, to provide alternative or additional embodiments within the scope of the invention.

The container filling assembly of the present invention may be used in high-speed container filling operations such as high-speed bottle filling. The container filling assembly of the present invention may be used in container operations of successive fillings where the quantity of fluid is variable and/or the levels and types of fluid materials is variable between each successive filling. Further, without being bound by theory, it is believed that equipment constraints and longer time constraints in conventional container filling lines is created by one or more factors, including, for example, the need to maintain a steady-state rate of flow throughout the mixing and dispensing stages during the filling cycle; the need to change parts of the assembly to account for different quantities of fluid and/or to have separate assemblies configured for different quantities of fluid; and/or the need to flush out materials undesired for subsequent fillings in between filling cycles to lessen cross-contamination. The container filling assembly of the present disclosure may address these challenges by providing the benefits of utilizing an individual assembly for successive filling cycles when the fluid compositions are composed of different quantities and/or materials, less space being occupied by multiple assemblies, and/or less wasted product and/or packaging in between successive filling cycles.

The assembly may achieve such benefits by separating the rate of mixing from the rate of dispensing through the use of a temporary storage chamber disposed between the mixing chamber and the dispensing chamber. Pressure devices such as piston pumps and air pumps may act upon the temporary storage chamber such that a user may adjust from the rate of mixing to the rate of dispensing without having to maintain a steady-state flow. The assembly may further achieve such benefits by having an adjusting mechanism that acts to change the adjusted volume of the temporary storage chamber as corresponding to the desired volume of fluid composition of the entire filling cycle. The assembly may further achieve such benefits by sufficiently removing residual materials and/or mixed fluid composition from the assembly inner walls such that the immediately subsequent filling cycle may produce a fluid composition having at or below an acceptable level of contamination.

The following description relates to a container filling assembly. Each of these elements is discussed in more detail below.

Definitions

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

As used herein, "acceptable level of contamination" may be construed as the maximum level of contamination that is acceptable to not affect the consumer experience, product efficacy, and safety of the fluid composition.

As used herein, the term "converge" may be construed as when the two or more materials come into a contacting relationship with each other.

As used herein, the term "chamber" may be construed as an enclosed or partially enclosed space through which air, fluid and other materials may move through.

As used herein, the term "cleaning composition" includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various pouches, tablet, granular, liquid and rinse-aid types for household and institutional use; liquid cleaning and disinfecting agents, including antibacterial hand-wash types, cleaning bars, mouthwashes, denture cleaners, dentifrice, car or carpet shampoos, bathroom cleaners; hair shampoos and hair-rinses; shower gels and foam baths and metal cleaners; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists.

As used herein, the terms "converge" and "combine" interchangeably refer to adding materials together with or without substantial mixing towards achieving homogeneity.

As used herein, the terms "mixing" and "blending" interchangeably refer to converging or combining of two or more materials and/or phases to achieve a desired product quality. Blending may refer to a type of mixing involving particulates or powders. "Substantially mixed" and "substantially blended" interchangeably may refer to thoroughly converging or combining two or more materials and/or phases such that any inhomogeneity is minimally detectable to a consumer and is not detrimental to the product efficacy and to the product safety. The inhomogeneity may be below a targeted threshold which can be analytically measured.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

As used herein, the term "fluid" and "fluid material" refer to a substance that offers little to no resistance to change of shape by an applied force, including, but not limited to liquids, vapors, gases, and solid particulates in suspension in a liquid, vapor or gas, or combinations of all of these.

As used herein, the term "material" refers to any substance or matter (element, compound or mixture) in any physical state (gas, liquid, or solid).

As used herein, the term "mixer" refers to any device used to combine materials.

As used herein, the term "mixture" refers to the converging or combining of materials in a process without chemical reaction. It can involve more than one phase such as a solid and a liquid or an emulsion of liquids. The term "homogeneous mixture" refers to a dispersion of components having a single phase. The term "heterogeneous mixture" refers to a mixture of two or more materials where the various components can be distinguished or having distinct phases. The term "component" refers to a constituent in a mixture that is defined a phase or as a chemical species.

As used herein, the term "product" refers to a chemical substance formed as the output from a process or unit operation that has undergone chemical, physical, or biological change.

As used herein, the term "steady state" refers to a condition in which the net change between the input and output to a process or system is zero and there is no dependence on time. "Steady-state flow" refers to the flow of a fluid into a space such that there is no loss or accumulation, and it is therefore unvarying with respect to time.

As used herein, the term "pass through" in reference to a valve is intended to be a broad reference to fluid moving past the stopping structure of a valve as intended when the valve is in an open configuration. Thus, the term encompasses any intended movement of fluid from the inlet of a valve to an outlet of the valve past the stopping structure of the valve. The term is not intended to be limited to situations where the fluid only passes within the stopping structure of the valve itself, but rather, includes fluid passing through the stopping structure, around the stopping structure, over the stopping structure, within the stopping structure, outside of the stopping structure, etc. or any combination thereof.

As used herein, the terms "rate of flow" and "flow rate" interchangeably refer to the movement of material per unit time. The volumetric flow rate of fluid moving through a pipe is a measure of the volume of fluid passing a point in the system per unit time. The volumetric flow rate may be calculated as the product of the cross-sectional area for flow and the average flow velocity.

A "substance" refers to any material that has a definite chemical composition. A substance may be a chemical element, a compound, or an alloy.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 10%, or less than 5%, or less than 1%, or even 0%, by weight of the composition.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Filling Operation Having a Container Filling Assembly

FIG. 1 shows an example of a container filling operation 4 that could be used in manufacturing plants to complete successive filling cycles. The filling operation 4 may be the process in which containers 7, 8, 9, are filled with a desired volume of fluid composition 60 and may comprise providing a container filling assembly 5, containers in various stages of filling 7, 8, 9, and a means of moving the containers 7, 8, 9, such as a conveyor belt 6. FIG. 1 exemplifies three containers at different stages of the filling cycle. FIG. 1 shows an empty container 7 that has not yet been filled with the fluid composition 60; a container 8 in the midst of being filled with the fluid composition 60; and a completed container 9 that is filled with the desired quantity of the fluid composition 60. Each container 7, 8, 9 has an opening 10 where the fluid composition 60 enters into the container 7, 8, 9. During the filling operation 4, empty containers 7, such as, for example, a bottle, are provided and placed adjacent the nozzle 95 of the container filling assembly 5 such that the nozzle 95 may be located adjacent the opening 10 of the container 8. The empty containers 7 may be provided by means of a conveyor belt, such as conveyor belt 6, or any other means suitable for supplying the containers 7. The completed containers 9 may be moved away from the assembly 5 by means of a conveyer belt, provided by means of a conveyor belt, such as conveyor belt 6, or any other means suitable for moving the containers 9.

The container filling assembly 5 may comprise a mixing chamber 25, a temporary storage chamber 65, and a dispensing chamber 85. The mixing chamber 25 may be located upstream of and in fluid communication with the temporary storage chamber 65. The dispensing chamber 85 may be located downstream of and in fluid communication with the temporary storage chamber 65. The assembly 5 may comprise a fluid composition 60. The fluid composition may comprise at least a first material 40 and a second material 55 different than the first material 40, wherein at least a portion of each of the first material 40 and the second material 55 converge within the mixing chamber 25 to form the fluid composition 60. The materials and fluid composition may flow along a fluid flow path 20 in the direction as shown in FIG. 1. The mixing chamber 25 may have a mixing chamber volume $V_1$ and a mixing chamber length $L_1$. The temporary storage chamber 65 may have a temporary storage chamber maximum volume $V_2$ and a temporary storage chamber length $L_2$. The temporary storage chamber 65 may have a temporary storage chamber adjusted volume $V_3$ and a temporary storage chamber adjusted length $L_3$. Although FIG. 1 shows the temporary storage chamber maximum volume $V_2$ as equal to the temporary storage chamber adjusted volume $V_3$ and the temporary storage chamber length $L_2$ as equal to the temporary storage chamber adjusted length $L_3$, it is to be understood that as the temporary storage chamber 65 is of variable volume and length, the adjusted volume $V_3$ and the adjusted length $V_3$ are capable of adjusting to different volumes and lengths throughout the filling cycle. The adjusted volume $V_3$ and adjusted length $L_3$ are further described hereinafter. The dispensing chamber 85 may have a dispensing chamber volume $V_4$ and a dispensing chamber length $V_5$.

The filling operation 4 may be used to complete successive filling cycles. A filling cycle may be a process in which the assembly 5 creates the fluid composition 60 and dispensing the fluid composition 60 into one container 8 or into any number of containers 8. The filling cycle may have a desired volume of fluid composition 60 which may depend upon the number of containers 8 to be filled and the desired volume of each container 8 to be filled. Each container 8 may have a desired volume $V_5$, as shown in FIG. 1, which is the volume of fluid composition desired for the container 8 to contain. The container desired volume $V_5$ may be less than the total volumetric capacity of the container 8, such that the container 8 is not overfilled with fluid composition. The total desired volume of the filling cycle may be the sum of the container desired volume $V_5$ of every container 8 desired to be filled within that filling cycle. The filling cycle ends once the entirety of the desired volume of the filling cycle has been dispensed into the one or multiple containers 8.

The filling cycle may be as follows:

Step (1) providing a container to be filled with a fluid composition, the container having an opening and a desired volume $V_5$;

Step (2) providing a container filling assembly, the container filling assembly comprising a mixing chamber in fluid communication with a temporary storage chamber enclosed by a temporary storage chamber housing, and a dispensing chamber in fluid communication with the temporary storage chamber and with a dispensing nozzle, the dispensing nozzle adjacent the opening of the container, wherein the temporary storage chamber is of variable volume and has a maximum volume $V_2$ and an adjusted volume $V_3$ corresponding to the desired volume of fluid composition of an entire filling cycle to be dispensed into a single container 8 or multiple containers 7, 8, 9;

Step (3) setting the temporary storage chamber to an adjusted volume $V_3$;

Step (4) moving the container 8 to be filled to be adjacent the nozzle 95;

Step (5) introducing two or more materials into the mixing chamber, where the materials combine to form a fluid composition;

Step (6) transferring the fluid composition to the temporary storage chamber at a first rate of flow, wherein the order of steps (3), (4) and (5) are interchangeable;

Step (7) transferring the fluid composition from the temporary storage chamber into the dispensing chamber at a second rate of flow such that the temporary storage chamber is no longer at the adjusted volume $V_3$;

Step (8) dispensing the fluid composition through the dispensing nozzle into the container through the container opening;

Step (9) moving the now filled container 9 from being adjacent the nozzle 95; and Step (10) repeating steps (2) through (9) until all of the desired volume of fluid composition 60 is dispensed from the assembly 5.

Step (6) may be known asnsert the first transfer step. Step (7) may be known as the second transfer step. The filling cycle may comprise multiple second transfer steps and dispensing steps depending upon the desired quantity of the fluid composition for the entire filling cycle and the container desired volume $V_5$.

Figure 2:
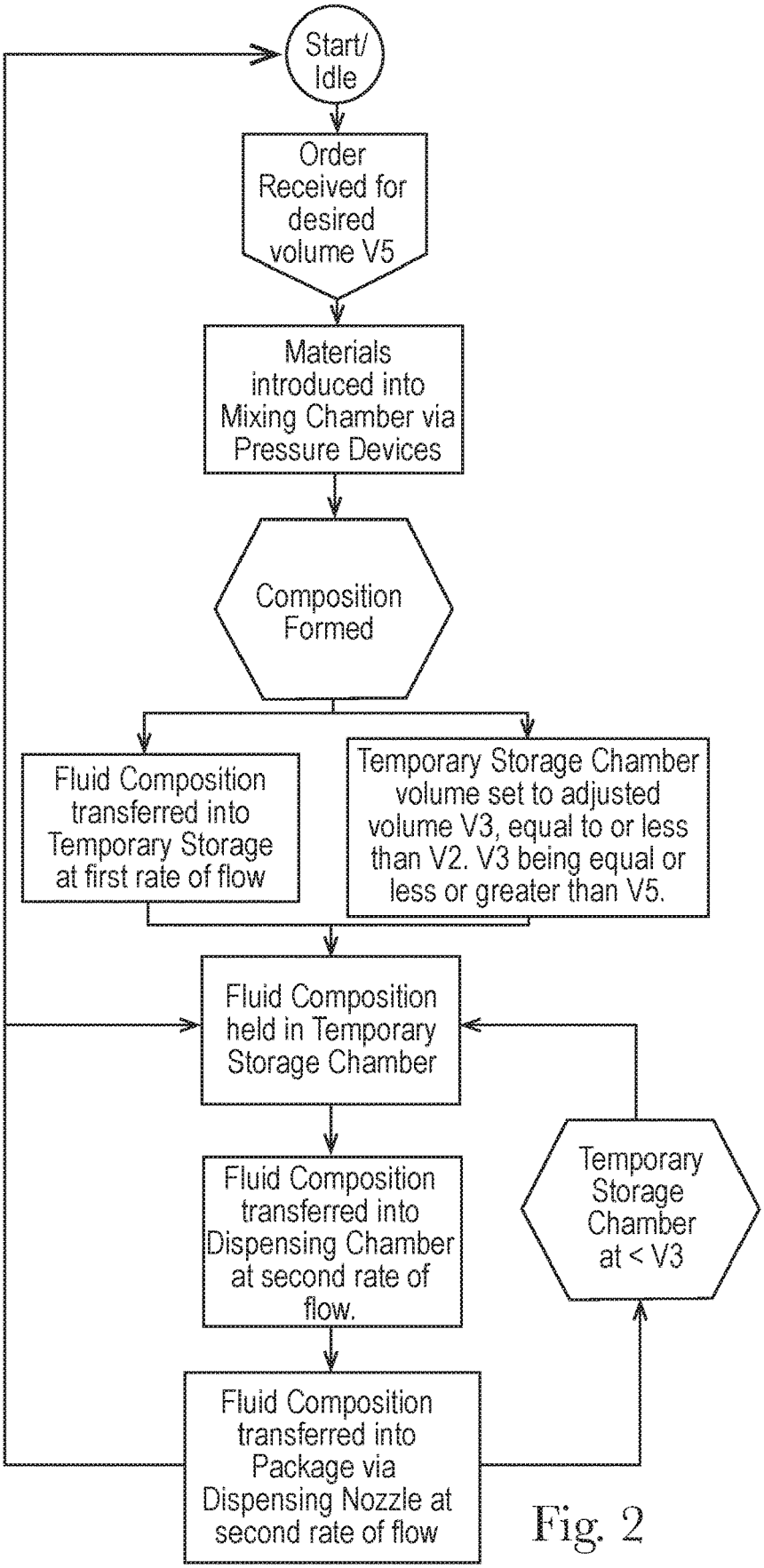
FIG. 2 is an exemplary schematic diagram of a method of filling containers using the assembly 5 wherein the second rate of flow is independently variable of the first rate of flow.

The assembly 5 may fill containers 8 such that the first rate of flow that occurs during the first transfer step is independently variable of the second rate of flow that occurs during the second transfer step. FIG. 2 shows an exemplary schematic diagram of a method of filling containers using the assembly 5 wherein the second rate of flow is independently variable of the first rate of flow.

Figure 3:
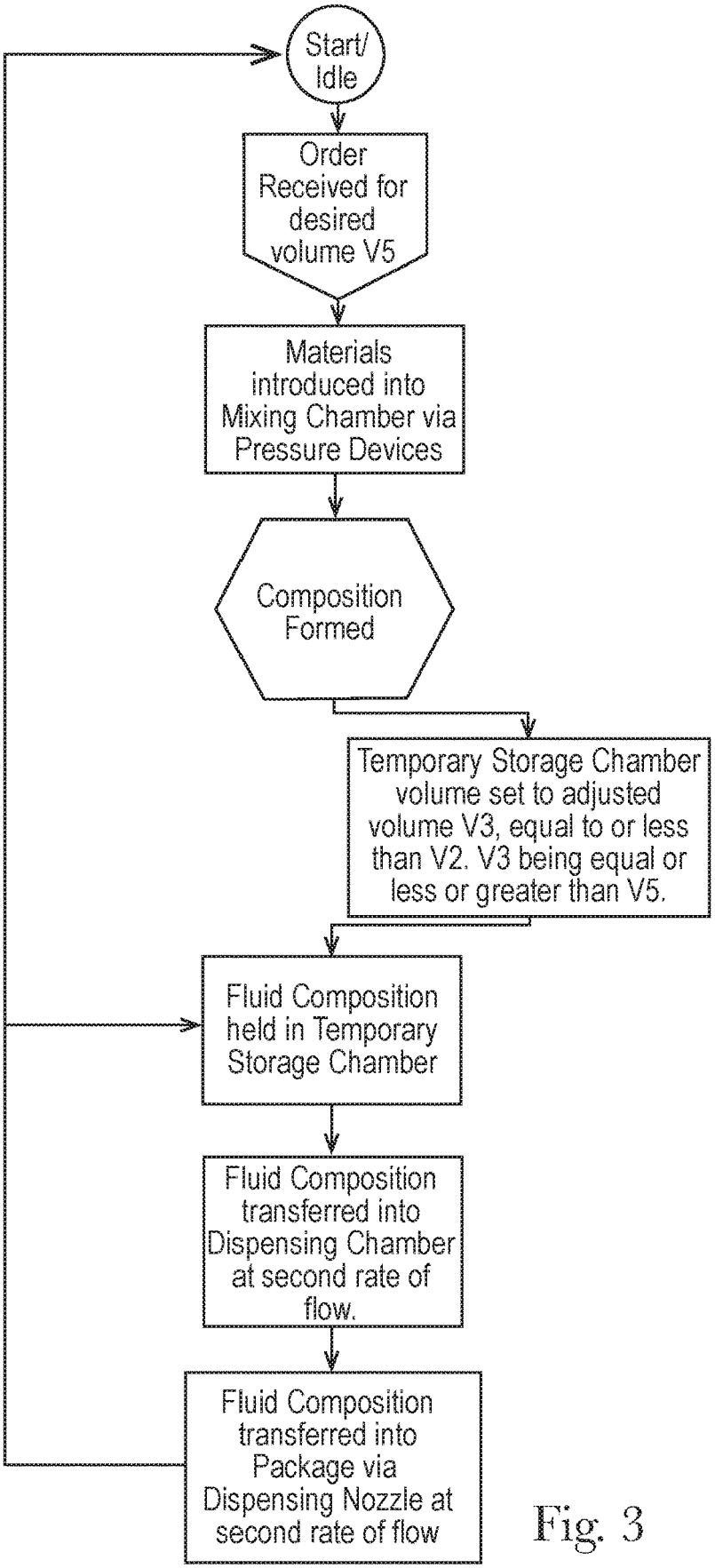
FIG. 3 shows an exemplary schematic diagram of a method of filling containers using the assembly 5 wherein the temporary storage chamber 65 is of variable volume and has a maximum volume $V_2$ and an adjusted volume $V_3$ corresponding to the desired volume of the fluid composition of the entire filling cycle.

The assembly 5 may fill containers 8 of different volumes $V_5$ during a single filling cycle. To accomplish this, the temporary storage chamber 65 of the assembly 5 may be of variable volume capable of being adjusted by an adjusting mechanism. FIG. 3 shows an exemplary schematic diagram of a method of filling containers using the assembly 5 wherein the temporary storage chamber 65 is of variable volume and has a maximum volume $V_2$ and an adjusted volume $V_3$ corresponding to the desired volume of the fluid composition of the entire filling cycle.

The filling operations 4 described herein are intended to be merely examples of filling operations that could include the container filling assembly 5 of the present invention. They are not intended to be limiting in any way. It is fully contemplated that other filling operations could be used with the container filling assembly 5 of the present invention, including but not limited to operations where more than one container is filled at one time, where containers other than bottles are filled, where different shape and/or size containers are filled, where containers are filled in different orientations than shown in the figure, where different filling levels are chosen and/or varied among containers, and where additional steps take place during the filling operation, such as, for example capping, washing, labeling, weighing, mixing, carbonating, heating, cooling, and/or radiating, etc. Further, the number of valves shown or described, their proximity to each other and other components of the container filling assembly 5 or any other equipment is not intended to be limiting, but merely exemplary.

Container Filling Assembly

Figure 4:
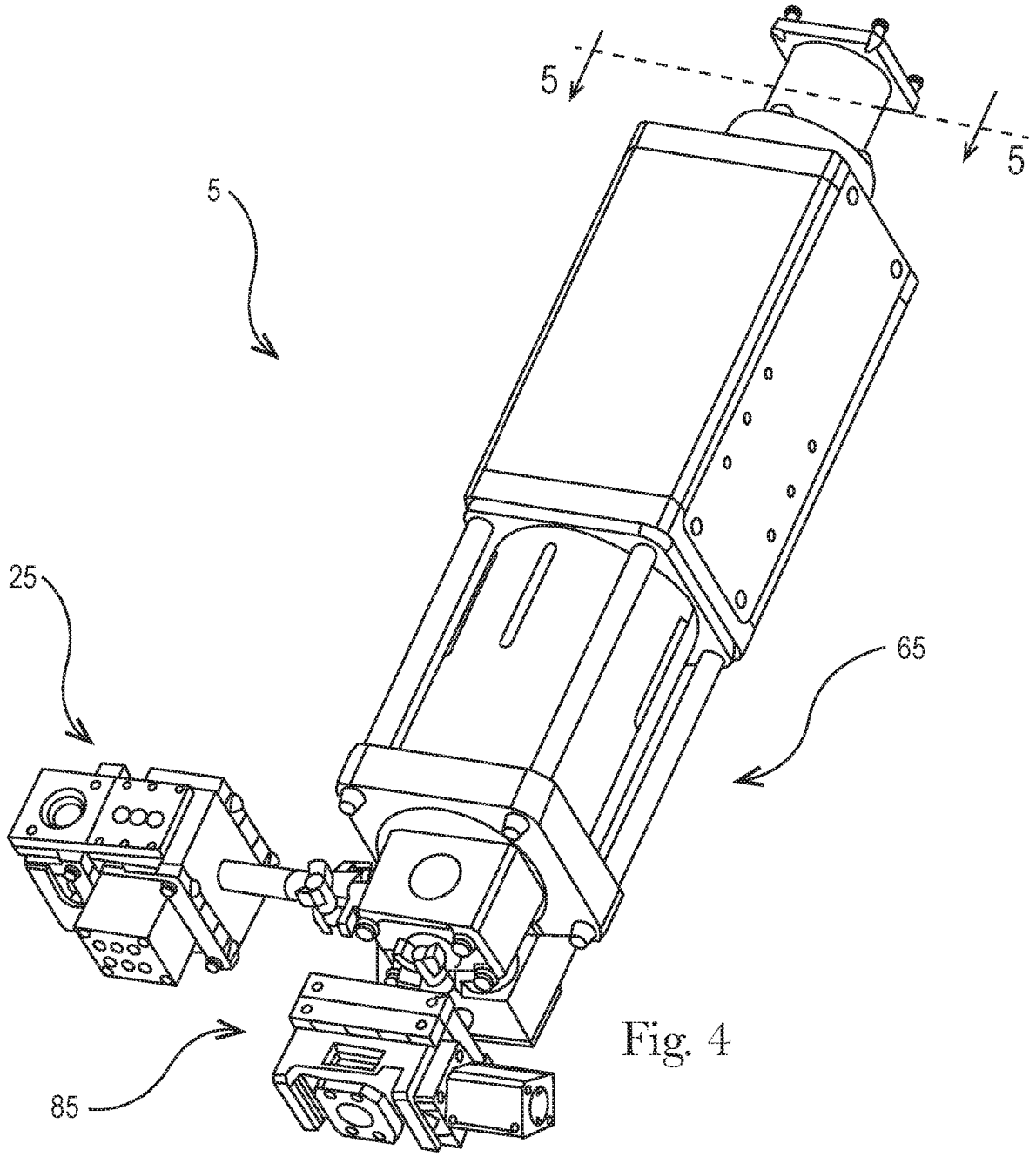
FIG. 4 is an isometric view of a non-limiting assembly.

FIG. 4 shows an isometric view of a non-limiting assembly 5 as may be found in a plant or manufacturing site showing the outer housing of the assembly 5. FIG. 4 identifies an axis of which FIGS. 5A-5F are cut.

Figure 5A:
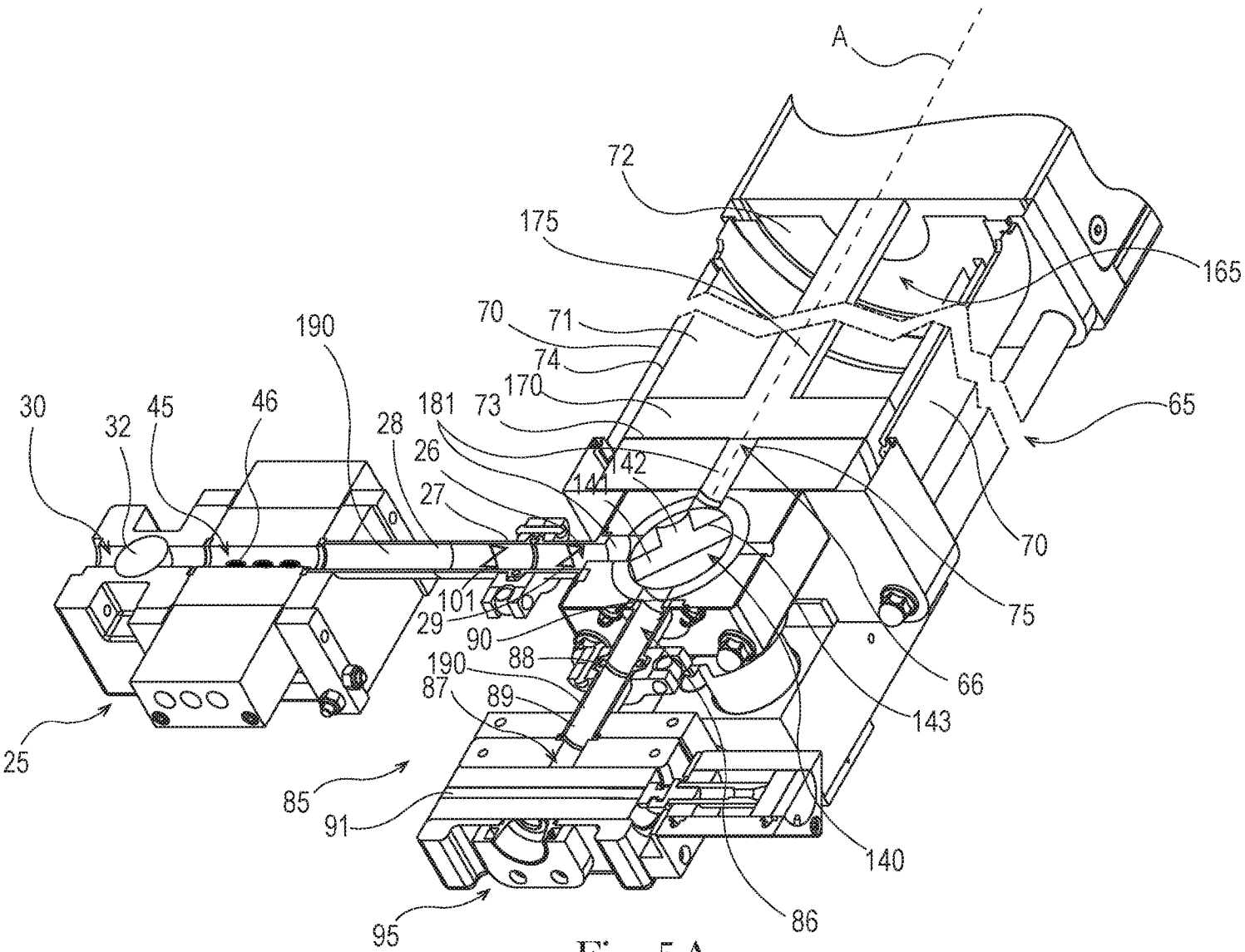
FIG. 5A is an isometric cross-sectional view taken along the line 5-5 of FIG. 4 of a container filling assembly having a three-way valve and a piston pump before the start of a filling cycle.

FIG. 5A shows an example of a container filling assembly 5 that has not yet begun the filling cycle. As previously stated, the container filling assembly 5 may comprise a mixing chamber 25, a temporary storage chamber 65, and a dispensing chamber 85. The assembly 5 may have one or more inlet orifices 30, 45, to receive the first material 40 and the second material 55 that are provided to form the fluid composition 60. At least a portion of the fluid composition 60 is formed within the mixing chamber 25 when at least a portion of each of the first material 40 and the second material 55 converge. The assembly 5 may further comprise two or more valves for controlling the passage of the fluid composition through the assembly 5. The assembly 5 may comprise a first valve 101 in fluid communication with the mixing chamber 25 and the temporary storage chamber 65. The first valve 101 may initiate, regulate, or stop the flow of the fluid composition 60 from the mixing chamber 25 into the temporary storage chamber 65. The assembly 5 may comprise a second valve 121 (shown in FIGS. 5C-5F) in fluid communication with the temporary storage chamber 65 and the dispensing chamber 85. The second valve 121 may initiate, regulate, or stop the flow of the fluid composition 60 from the temporary storage chamber 65 into the dispensing chamber 85. It should be understood that the assembly 5 may further comprise any additional number of valve components necessary. As the filling cycle has not yet begun, all of the valves in the assembly 5 as shown in FIG. 5A are in a closed configuration and the materials 40, 55 have not yet begun to flow into the assembly 5.

Materials 40, 55 may enter into the container filling assembly 5 through the mixing chamber 25. The mixing chamber 25 may be a space, enclosed by a mixing chamber housing 27, where two or more materials may converge to form a mixed fluid composition. The mixed fluid composition may be a mixture. The mixing chamber housing 27 may have a mixing chamber housing inner surface 28. The mixing chamber 25 may comprise a first material inlet orifice 30 in fluid communication with a source of a first material and a second fluid inlet orifice 45 in fluid communication with a source of a second material. The source of first material may provide a first material 40 and the source of second material may provide a second material 55. The first material inlet orifice 30 and the second material inlet orifice 45 may be disposed on the mixing chamber housing 27 which may allow for the first material 40 and second material 55 to enter into the mixing chamber 25. The first material inlet orifice 30 may comprise a first material inlet valve 32 and the second material inlet orifice 45 may comprise a second material inlet valve 46. Each of the first and second material inlet valves 32, 46 may initiate, regulate or stop the flow of each respective material 40, 55 into the mixing chamber 25. Each of the first and second material inlet valves 32, 46 may have an open configuration wherein the respective material 40, 55 is able to pass through the respective material inlet valve 32, 46 and a closed configuration wherein the respective material 40, 55 is unable to pass through the respective material inlet valve 32, 46. Each of the first and second material valve 32, 46 may operate independently of each other such that, for example, when the first material inlet valve 32 is in the open configuration, the second material inlet valve 46 is in the closed configuration, or, in the alternative, when the first material inlet valve 32 is in the closed configuration, the second material inlet valve 46 is in the open configuration. FIG. 5A shows both the first material inlet valve 32 and the second material inlet valve 46 in the closed configuration as signals have not yet been transmitted to cause the valves 32, 46 to move to the open configuration to initiate flow.

The mixing chamber 25 may further comprise a mixing chamber outlet orifice 26 downstream of the first and second material inlet orifices 30, 45. The mixing chamber outlet orifice 26 may be disposed on the mixing chamber housing 27 which may allow the fluid composition 60 to exit the mixing chamber 25. The mixing chamber outlet orifice 26 may comprise a mixing chamber outlet valve 29 which may initiate, regulate, or stop the flow of fluid, including the fluid composition 60 or either the first or second material 40, 55 from the mixing chamber 25 into other parts of the assembly 5. It is contemplated that the mixing chamber outlet valve 29 may be the first valve 101, or may be separate of the first valve 101 such as shown in FIG. 5A. The mixing chamber outlet valve 29 may have an open configuration wherein fluid, including the fluid composition 60 or either the first or second material 40, 55, may be able to pass through the mixing chamber outlet valve 29. The mixing chamber outlet valve 29 may have a closed configuration wherein fluid, including the fluid composition 60 or either the first or second material 40, 55, may not be able to pass through the mixing chamber outlet valve 29.

It should be understood that the first material 40 and the second material 55 may converge in the mixing chamber 25 to form the fluid composition 60 within the mixing chamber 25. However, the present disclosure is not so limited. The first material 40 and second material 55 need not flow into the mixing chamber 25 at the same time or for the same duration of time. Initiation and duration of flow of the first material 40 and of the second material 55 may occur in any such combination to provide the desired fluid composition product 60. It is contemplated that either the first material 40 or the second material 55 may flow through the mixing chamber 25 without converging with any other material. This may occur, for example, when it is desired for the fluid composition 60 to be followed by some quantity of either the first material 40 or the second material 55 when that first material 40 or second material 55 is contemplated for use in the immediately succeeding filling cycle, such that the immediately subsequent filling cycle may produce a fluid composition having at or below an acceptable level of contamination. This may also occur, for example, when either the first material 40 or the second material 55 flows through the mixing chamber 25 into the temporary storage chamber 65 without converging with any other material; followed by the other material to clear out any residual individual material remaining on the mixing chamber housing inner surface 28, wherein the fluid composition 60 may actually be formed within the temporary storage chamber 65. For simplicity, reference to the fluid composition 60 in any context involving the flow of fluid from the mixing chamber 25 into the temporary storage chamber 65 may refer to either the first material 40, the second material 55, or the fluid composition 60 as a mixture of the first and second materials 40, 55. In instances when it is of particular importance for fluid flowing from the mixing chamber 25 into the temporary storage chamber 65 to be the individual first or second material 40, 55, the fluid will be definitively stated as the individual first or second material 40, 55

The mixing chamber 25 may be in direct fluid communication with a temporary storage chamber 65, disposed downstream of the mixing chamber 25. The temporary storage chamber 65 may be a space enclosed by a temporary storage chamber housing 70 having an inward facing temporary storage chamber housing inner surface 71. The temporary storage chamber housing 70 may comprise a first wall 72, an opposing second wall 73, and side walls 74 extending from and connecting the first wall 72 to the second wall 73. It should be understood that the side walls 74 may refer to one continuous wall when the temporary storage chamber 65 is, for example, of cylindrical shape or several connected walls when the temporary storage chamber 65 is, for example, of rectangular shape. As described hereinafter, it should be understood that the temporary storage chamber housing 70 may not be so limited as to having a defined structure, such as when, for example, the temporary storage chamber housing 70 comprises a flexible material that enables the shape of the temporary storage chamber housing 70 to be dynamic. The temporary storage chamber housing 70 may be comprised of a material selected from the group consisting of an inflexible material, a flexible material, and combinations thereof. FIG. 5A shows an example of an inflexible material having a structure of a first wall 72, a second wall 73, and side walls 74. The temporary storage chamber housing 70 may comprise a flexible material. In a non-limiting example, the temporary storage chamber housing 70 may be of a flexible rubber and may expand as it is filled with fluid composition 60 and contract as the fluid composition 60 is evacuated, or dispensed, from the temporary storage chamber 65.

The temporary storage chamber 65 may comprise a temporary storage chamber inlet orifice 66 where the fluid composition 60 may enter into the temporary storage chamber 65. The temporary storage chamber inlet orifice 66 may be disposed on the temporary storage chamber housing 70, which may allow the fluid composition to enter the temporary storage chamber 65. FIG. 5A shows the temporary storage chamber inlet orifice 66 disposed on the second wall 73. The temporary storage chamber inlet orifice 66 may comprise a temporary storage chamber inlet valve 75 which may initiate, regulate, or stop the flow of the fluid composition flowing into the temporary storage chamber 65. The temporary storage chamber inlet valve 75 may have an open configuration wherein the fluid composition 60 may be able to pass through temporary storage chamber inlet valve 75. The temporary storage chamber inlet valve 75 may have a closed configuration wherein the fluid composition 60 may not be able to pass through the temporary storage chamber inlet valve 75. The temporary storage chamber inlet valve 75 may be in fluid communication with the mixing chamber outlet valve 29 such that the fluid composition 60 may be transferred from the mixing chamber 25 into the temporary storage chamber 65 at a first rate of flow.

The first valve 101 may be in fluid communication with the mixing chamber outlet valve 29 and the temporary storage chamber inlet valve 75. It is contemplated that in certain instances, the first valve 101 may comprise the mixing chamber outlet valve 29 such that the mixing chamber outlet valve may serve as the first valve 101. It is contemplated that in certain instances, the first valve 101 may comprise the temporary storage chamber inlet valve 76 such that the temporary storage chamber inlet valve 76 may serve as the first valve 101. It is contemplated that in certain instances, the first valve 101 may comprise the temporary storage chamber inlet valve 76 and the mixing chamber outlet valve 29 such that the temporary storage chamber inlet valve 76 and the mixing chamber outlet valve may serve as the first valve 101. Additionally, when the assembly 5 comprises a three-way valve 140 as shown in FIG. 5A, it is contemplated that the first valve 101 may comprise the three-way valve 140 such that the three-way valve 140 may serve as the first valve 101.

Figure 5B:
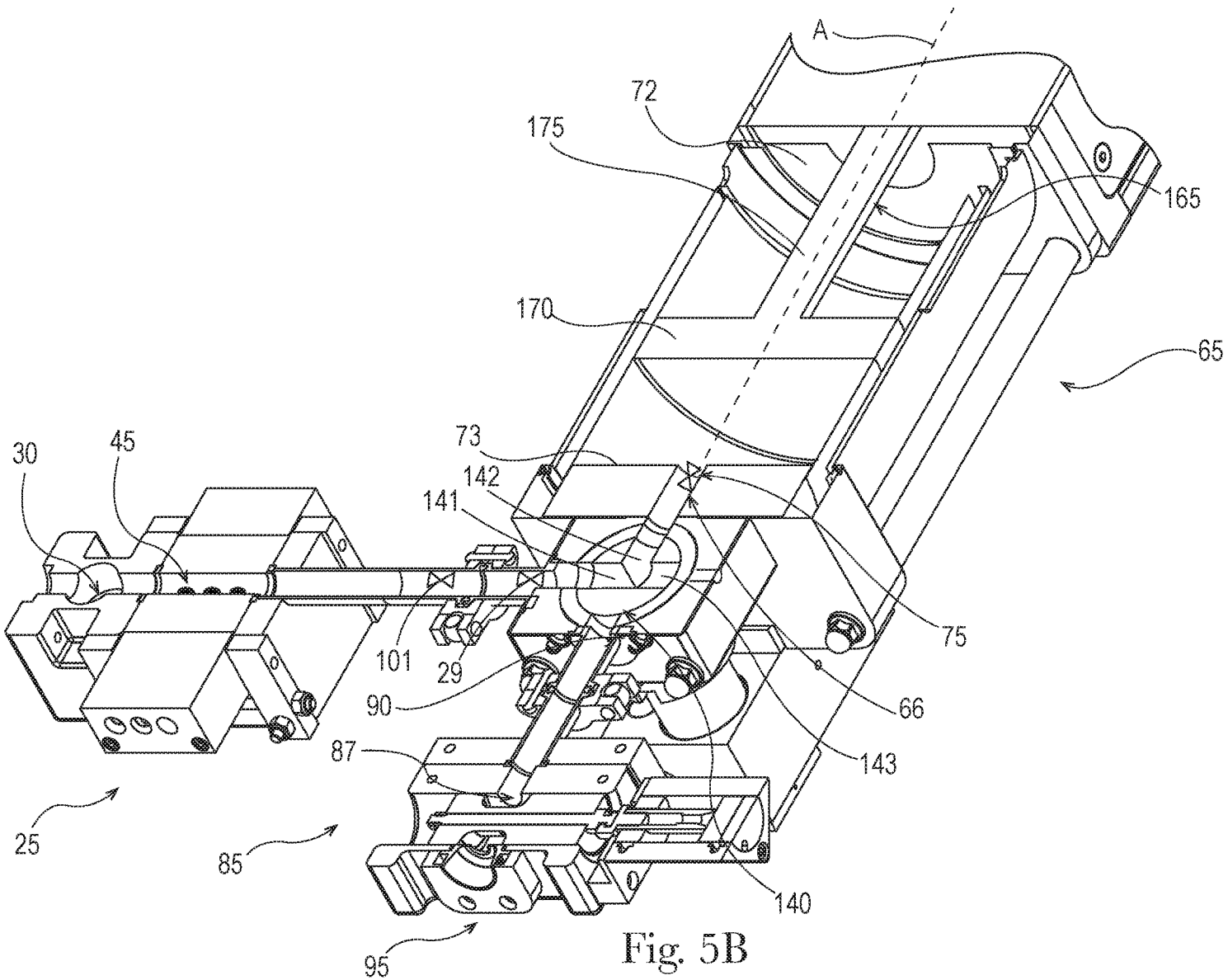
FIG. 5B is an isometric cross-sectional view taken along the line 5-5 of FIG. 4 of a container filling assembly having a three-way valve and a piston pump undergoing a first transfer step.

The temporary storage chamber 65 may comprise a temporary storage chamber outlet orifice 67 (shown in FIGS. 5C-5F) wherein the fluid composition 60 may exit the temporary storage chamber 65. The temporary storage chamber outlet orifice 67 may be disposed on the temporary storage chamber housing 70, which may allow the fluid composition to exit the temporary storage chamber 65. It is contemplated that the temporary storage chamber outlet orifice 67 may be the same orifice as the temporary storage chamber inlet orifice 66, such as shown in FIGS. 5A-5B. The temporary storage chamber outlet orifice 67 may comprise a temporary storage chamber outlet valve 76 (shown in FIGS. 5C-5F) which may initiate, regulate, or stop the flow of the fluid composition flowing out of the temporary storage chamber 65. The temporary storage chamber outlet valve 76 may have an open configuration wherein the fluid composition 60 may be able to pass through temporary storage chamber outlet valve 76. The temporary storage chamber outlet valve 76 may have a closed configuration wherein the fluid composition 60 may not be able to pass through the temporary storage chamber outlet valve 76. The temporary storage chamber outlet valve 76 may be in fluid communication with a dispensing chamber inlet valve 90 such that the fluid composition 60 may flow from the temporary storage chamber 65 into the dispensing chamber 85 at a second rate of flow.

The temporary storage chamber 65 may be in direct fluid communication with a dispensing chamber 85, disposed downstream of the temporary storage chamber 65. The dispensing chamber 85 may be a space, enclosed by a dispensing chamber housing 88, where the fluid composition 60 flows through and ultimately exits the assembly 5 through a dispensing nozzle 95. The dispensing nozzle 95 may be attached to the dispensing chamber 85 or may be formed as a part of the dispensing chamber 85. The dispensing chamber housing 88 may have an inward facing dispensing chamber housing inner surface 89.

The dispensing chamber 85 may comprise a dispensing chamber inlet orifice 86 wherein the fluid composition may enter into the dispensing chamber 85. The dispensing chamber inlet orifice 86 may be disposed on the dispensing chamber housing 88, which may allow the fluid composition to enter the dispensing chamber 85. The dispensing chamber inlet orifice 86 may comprise a dispensing chamber inlet valve 90 which may initiate, regulate, or stop the flow of the fluid composition flowing into the dispensing chamber 85. The dispensing chamber inlet valve 90 may have open configuration wherein the fluid composition 60 may be able to pass through dispensing chamber inlet valve 90. The dispensing chamber inlet valve 90 may have a closed configuration wherein the fluid composition 60 may not be able to pass through the dispensing chamber inlet valve 90. The dispensing chamber inlet valve 90 may be in fluid communication with the temporary storage chamber outlet valve 76, such that the fluid composition 60 may flow from the temporary storage chamber 65 into the dispensing chamber 85 at a second rate of flow.

The dispensing chamber 85 may comprise a dispensing chamber outlet orifice 87 wherein the fluid composition 60 may exit the dispensing chamber 85. The dispensing chamber outlet orifice 87 may be disposed on the dispensing chamber housing 88, which may allow the fluid composition 60 to exit the dispensing chamber 85. The dispensing chamber outlet orifice 88 may comprise a dispensing chamber outlet valve 91 which may initiate, regulate, or stop the flow of the fluid composition 60 flowing out of the dispensing chamber 85. The dispensing chamber outlet valve 91 may have an open configuration wherein the fluid composition 60 may be able to pass through dispensing chamber outlet valve 91. The dispensing chamber outlet valve 91 may have a closed configuration wherein the fluid composition 60 may not be able to pass through the dispensing chamber outlet valve 91. The dispensing chamber outlet valve 91 may be in fluid communication with the nozzle 95, such that the fluid composition 60 may flow from the dispensing chamber 85 into and through the nozzle 95 at the second rate of flow. It is contemplated that the nozzle may comprise the dispensing chamber outlet valve 91.

The second valve 121 (shown in FIGS. 5C-5F) may be in fluid communication with the temporary storage chamber 65 and the dispensing chamber 85. The second valve 121 may be in fluid communication with the temporary storage chamber outlet valve 76 and the dispensing chamber inlet valve 90. It is contemplated that in certain instances, the second valve 121 may comprise the temporary storage chamber outlet valve 76 such that the temporary storage chamber outlet valve 76 may serve as the second valve 121. It is contemplated that in certain instances, the second valve 121 may comprise the dispensing chamber inlet valve 90 such that the dispensing chamber inlet valve 90 may serve as the second valve 121.

As shown in FIG. 5A, the assembly 5 may comprise a three-way valve 140. The three-way valve 140 may be rotatable between a first position, a second position, and a closed position. FIG. 5A shows the three-way valve 140 in the closed position as the filling cycle has not yet begun. When the three-way valve 140 is in the first position (as shown in FIG. 5B) the three-way valve 140 is in fluid communication with the mixing chamber 25 and the temporary storage chamber 65. When the three-way valve 140 is in the second position (as shown in FIG. 5D) the three-way valve 140 is in fluid communication with the temporary storage chamber 65 and the dispensing chamber 85. When the three-way valve 140 is in the closed position (as shown in FIGS. 5A, 5C, 5E, and 5F) the three-way valve 140 is not in fluid communication with any of the mixing chamber 25, the temporary storage chamber 65, or the dispensing chamber 85.

The three-way valve 140 may have a first pipe 141, a second pipe 142, and a third pipe 143 for conducting the flow of fluid. It is contemplated that the first valve 101 may comprise the first pipe 141 and the second pipe 142. It is contemplated that the second valve 121 may comprise the first pipe 141 and the third pipe 143. As shown in FIG. 5A, before initiation the transfer of fluid composition 60 into the temporary storage chamber 65, the first valve 101 is in the closed configuration and fluid is unable to enter into the first valve 101 through the first pipe 141. It is contemplated that the first valve 101 and the second valve 121 may comprise any combination of the first, second and third pipes 141, 142, 143.

The assembly 5 may comprise one or more transfer channels for connecting the different parts of the assembly 5 and through which the fluid composition 60 may flow. The assembly 5 may comprise a first transfer channel 181 operatively connecting the mixing chamber 25 to the temporary storage chamber 65. The assembly 5 may comprise a second transfer channel 185 (shown in FIGS. 5C-5F) operatively connecting the temporary storage chamber 65 and the dispensing chamber 85. Each channel 181, 185 may be, for example, a pipe encased in a housing.

The first transfer channel 181 may have a first transfer channel inlet orifice 182 (shown in FIG. 5B) operatively connected to the mixing chamber outlet orifice 26, which may allow the fluid composition 60 to flow from the mixing chamber 25 into the first transfer channel 181. The first transfer channel 181 may have a first transfer channel outlet orifice 183 (shown in FIG. 5B) operatively connected to the temporary storage chamber inlet orifice 66, which may allow the fluid composition 60 to flow from the first transfer channel 181 into the temporary storage chamber 65. The first valve 101 may be disposed between the mixing chamber 25 and the temporary storage chamber 65. The first valve 101 may be disposed within or adjacent the first transfer channel 181.

The second transfer channel 185 may have a second transfer channel inlet orifice 186 (shown in FIGS. 5C-5F) operatively connected to the temporary storage chamber outlet orifice 67, which may allow the fluid composition 60 to flow from temporary storage chamber 65 into the second transfer channel 185. The second transfer channel 185 may have a second transfer channel outlet orifice 187 (shown in FIGS. 5C-5F) operatively connected to the dispensing chamber inlet orifice 86, which may allow the fluid composition 60 to flow from the second transfer channel 185 into the dispensing chamber 85. The second valve 121 may be disposed between the temporary storage chamber 65 and the dispensing chamber 85. The second valve 121 may be disposed within or adjacent the second transfer channel 185.

The temporary storage chamber 65 may comprise an adjusting mechanism configured to adjust the volume of the temporary storage chamber 65. The adjusting mechanism may provide the benefit of using the same assembly 5 and assembly components when using the assembly 5 to produce different types and/or volumes of fluid compositions in between successive filling cycles because the components do not have to be changed for smaller or larger chambers or tanks, but instead, simply adjusted to the desired volume of the filling cycle. The adjusting mechanism may comprise one or more pressure devices for controlling the first rate of flow at which the fluid composition 60 flows from the mixing chamber 25 into the temporary storage chamber 65. The pressure devices may provide the benefit of being configured to cause the materials 40, 55 to flow at a particular flow rate to cause mixing of the materials 40, 55 for the desired transformation of the fluid composition 60. The pressure devices may be a piston pump 165, as shown in FIGS. 5A-5F, and further described hereinafter. It is contemplated that the pressure device can be a device that provides suitable force on the temporary storage chamber 65, temporary storage chamber housing 70 and/or fluid composition 60 to control the first rate of flow to cause the predetermined mixing of the materials 40, 55 to achieve the desired transformation of the fluid composition 60. The pressure device may be one or more air pumps 144 (shown in FIGS. 7A-7F).

As shown in FIGS. 5A-5F, the pressure device can be a piston pump 165. The piston pump 165 may be located at least partially within the temporary storage chamber 65. The piston pump 165 may comprise a piston pump shaft 175 and a piston pump plate 170 attached to the piston pump plate 170. The piston pump 165 may be movable along an axis A perpendicular to the second wall 73. As shown in FIG. 5A, before initiation of the transferring of fluid into the temporary storage chamber 65, the piston pump 165 may be in a resting position wherein the piston pump plate 170 is disposed adjacent the second wall 73. The piston pump 165, particularly the piston pump plate outer border 172 (as shown and described hereinafter in FIG. 6), may be slideably movable about the temporary storage housing inner surface 71. The piston pump 165 may comprise one or more seals 176 surrounding the piston pump plate outer border 172 (as shown and described hereinafter in FIG. 6), such that the fluid composition 60 cannot flow between the piston pump plate 170 and the temporary storage chamber housing inner surface 71.

Optionally, the assembly 5 may further comprise one or more mixers 190, disposed within the mixing chamber 25, the first transfer channel 181, the dispensing chamber 85, and/or the second transfer channel 185, and any combination thereof. FIG. 5A shows a static mixer 190 disposed within the mixing chamber 25. FIG. 5A, further described hereinafter, shows a static mixer 190 disposed within the dispensing chamber 85. The one or more mixers 190 may be selected from the group consisting of static mixers, dynamic mixers, and combinations thereof. The mixers 190 may be any such mixer known to one skilled in the art to provide additional input of energy to create laminar and/or turbulent mixing. As both the mixing chamber 25 and the first transfer channel 181 are upstream to the temporary storage chamber 65, either or both the mixing chamber or the first transfer channel 181 having one or more mixers 190 disposed within may provide for greater mixing before fluid enters into the temporary storage chamber 65. As both the dispensing chamber 85 and the second transfer channel 185 are downstream to the temporary storage chamber 65, either or both the dispensing chamber 85 and the second transfer channel 185 having one or more mixers 190 disposed within may provide for greater mixing after the fluid composition exits the temporary storage chamber 65 but before the fluid composition 60 is dispensed into the container 8. The temporary storage chamber 65 may be devoid of mixers 190. As the mixer 190 is a physical object, if a mixer 190 is disposed within the temporary storage chamber 65, it may be more difficult for the cleaning mechanism to effectively remove any residual fluid from the temporary storage chamber 65. When the cleaning mechanism comprises a physical structure, such as for example a piston pump 165, the cleaning mechanism may be obstructed from effectively cleaning the temporary storage chamber 65 by the mixer 190.

FIG. 5B shows the assembly 5 transferring the fluid composition 65 from the mixing chamber 25 to the temporary storage chamber 65. During this first transfer step, the materials may flow into the mixing chamber 25 and converge to form a fluid composition. The materials may flow individually into the mixing chamber 25 without converging with each other. During this first step, the materials and/or fluid composition may flow from the mixing chamber 25 to the temporary storage chamber 65 at a first rate of flow. The first rate of flow may be caused by the negative pressure imparted upon the temporary storage chamber 65 by the piston pump 165.

This first step may be accomplished as followed. First, a signal is transmitted from a controller to a drive which may cause the first material inlet valve 32 and/or the second material inlet valve 46 to move from the closed configuration to the open configuration. As such, flow of the first material 40 and/or the second material 55 may be initiated into the mixing chamber 25 from each respective source of material. Signals may be transmitted to the mixing chamber outlet valve 29, to the first valve 101 and/or to the temporary storage chamber inlet valve 75, depending upon the configuration of the assembly 5, to move from the closed configuration to the open configuration, such that fluid will be able to flow from the mixing chamber 25 into the temporary storage chamber 65. Once the corresponding valves are in the open configuration, a signal may be transmitted to cause a servo motor to initiate activation of a first motive force device to impart negative pressure onto the temporary storage chamber 65. The first motive force device may be any such device known to one skilled in the art that can create a pressure differential between the mixing chamber 25 and the temporary storage chamber 65 such that fluid will flow in the direction of the fluid flow path 20 from the mixing chamber 25 into the temporary storage chamber 65. In FIGS. 5A-5F, the first motive force device is a piston pump 165. As the temporary storage chamber 65 is in fluid communication with the mixing chamber 25 and as all of the valves disposed between the mixing chamber 25 and the temporary storage chamber 65 are in the open configuration, the negative pressure, or vacuum, will apply to the materials 40, 55 within the mixing chamber 25, causing the materials 40, 55 and/or the fluid composition 60 to flow out of the mixing chamber 25 and into the temporary storage chamber 65. As all of the valves disposed between the mixing chamber 25 and the temporary storage chamber 65 are in the open configuration, the materials 40, 55 and/or fluid composition 60 will pass through the valves. The first rate of flow may be configured to enable a desired level of mixing, or transformation, of the materials 40, 55, within the mixing chamber 25 and/or within the temporary storage chamber 65.

When the assembly 5 comprises a piston pump 165 and a three-way valve 140, this first step may be accomplished as followed. A signal may be transmitted from a controller to a drive which may cause the three-way valve to 140 to rotate to the first position, wherein the three-way valve 140 is in fluid communication with the mixing chamber 25 and with the temporary storage chamber 65. As shown in FIG. 5A-5F, the three-way valve 140 may be in the first position such that both the first pipe 141 and the second pipe 142 are aligned and in fluid communication with the first transfer channel 181, the mixing chamber 25, and the temporary storage chamber 65. However, it is contemplated that any such combination of the pipes 141, 142, 143, that may enable fluid communication between the mixing chamber 25 and the temporary storage chamber 65 may occur. A signal may be transmitted to a servo motor to initiate movement, or a suction stroke, of the piston pump 165. The suction stroke of the piston pump 165 may be when the piston pump 165 is moved in a direction such as to impart a negative pressure on the temporary storage chamber 65 by creating a corresponding pressure differential. In FIG. 5B, the piston pump 165 is moving in a direction away from the second wall 73 towards the first wall 72, and in doing so, the temporary storage chamber 65 lengthens and increases in volume. This increase in volume acts to provide a vacuum, or at least a negative pressure, to the temporary storage chamber 65. As such, the mixed fluid composition 60 and/or individual materials 40, 55 may be transferred, or suctioned, from the mixing chamber 25 into the temporary storage chamber 65 as passing through the three-way valve 140.

Figure 5C:
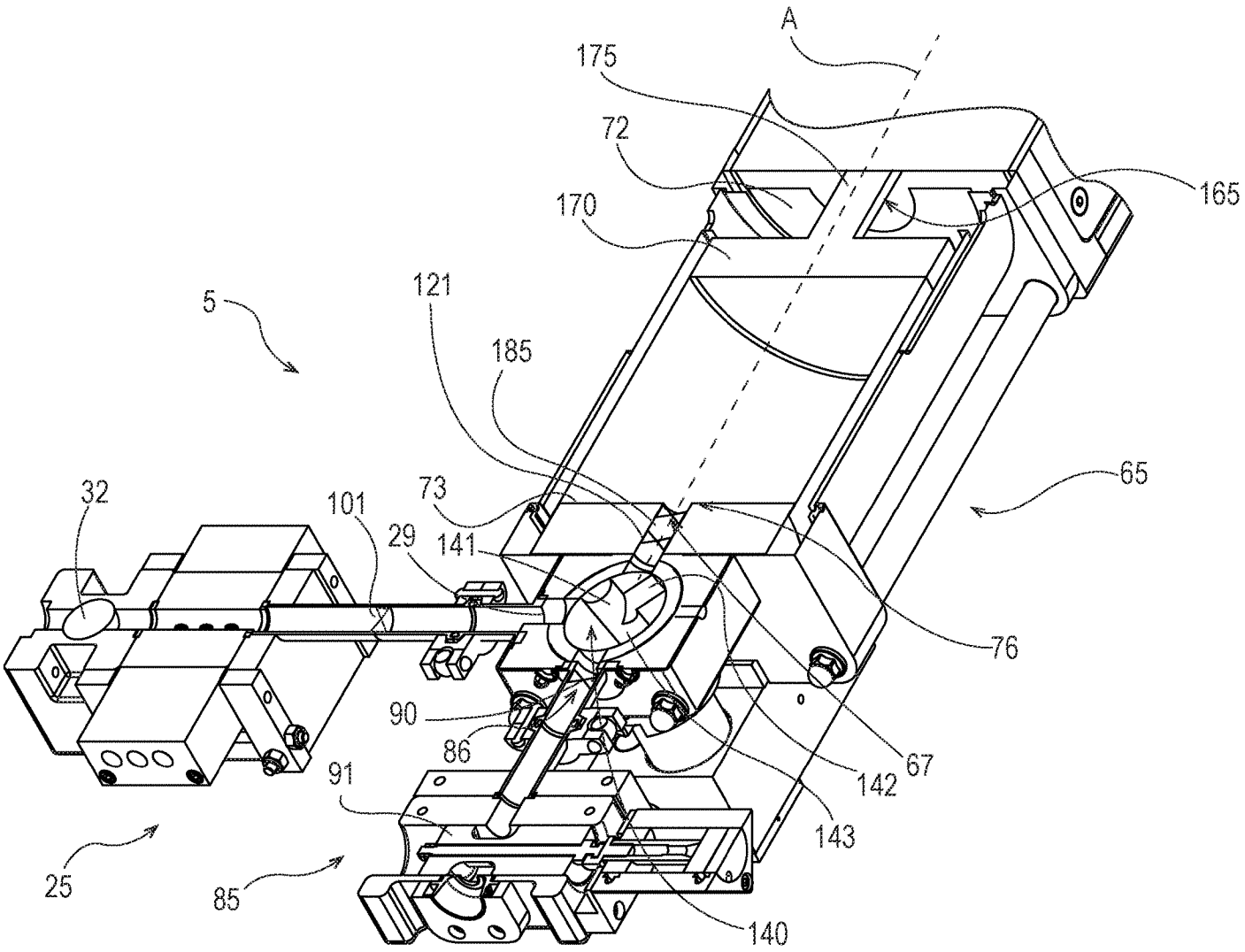
FIG. 5C is an isometric cross-sectional view taken along the line 5-5 of FIG. 4 of a container filling assembly having a three-way valve and a piston pump upon completion of a first transfer step and before the start of a second transfer step.
Figure 5D:
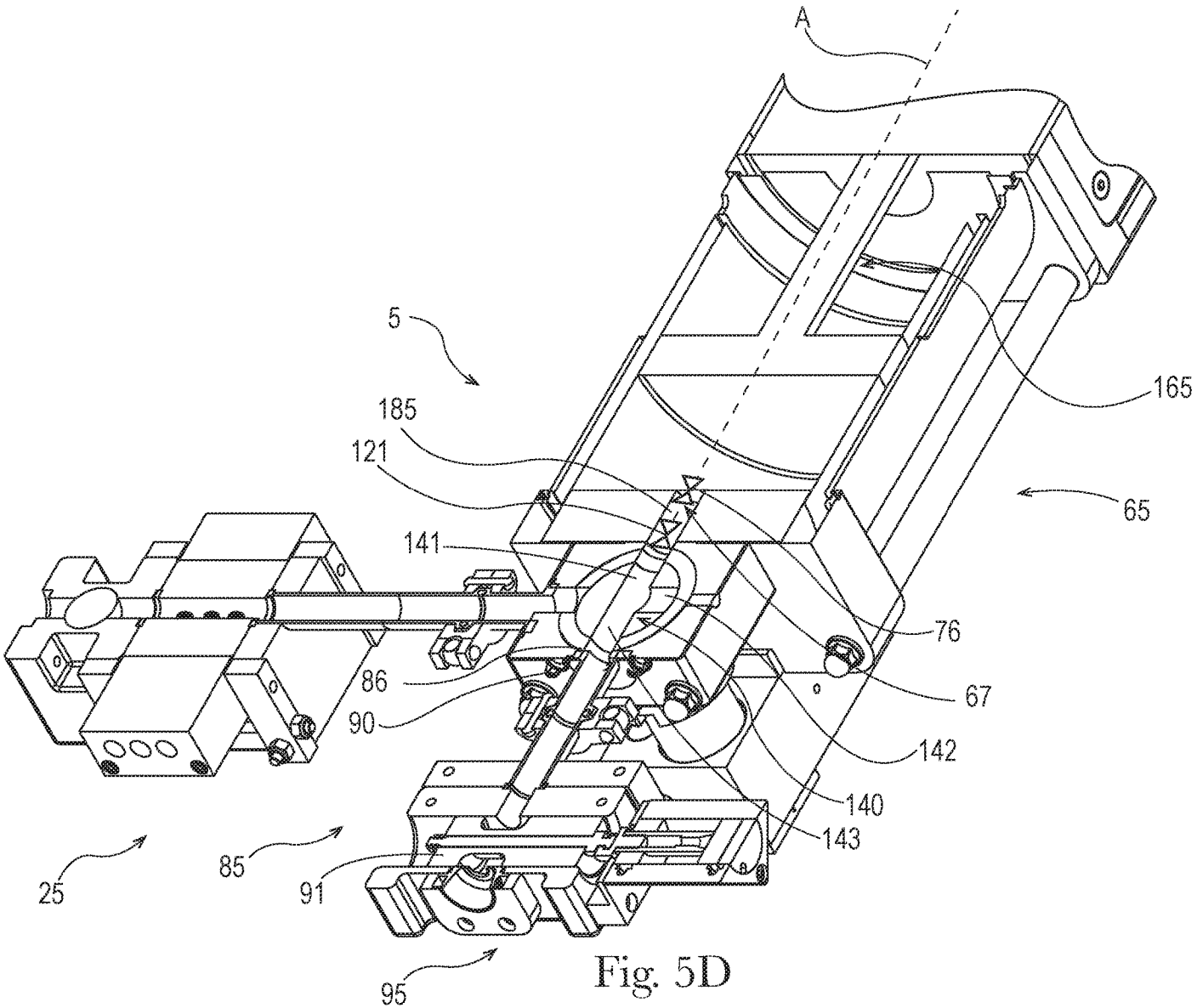
FIG. 5D is an isometric cross-sectional view taken along the line 5-5 of FIG. 4 of a container filling assembly undergoing a second transfer step.

FIG. 5C shows a non-limiting example of the assembly 5 after completion of the first transfer step but before initiation of the second transfer step. Once the desired quantity of fluid composition 60 is within the temporary storage chamber 65, a signal may be transmitted to cause the servo motor to stop movement of the first motive force device, in FIG. 5C, the piston pump 165. As such, the piston pump 165 may stop imparting negative pressure onto the temporary storage chamber 65 and fluid in turn will stop flowing from the mixing chamber 25 into the temporary storage chamber 65. Signals may be transmitted to the first material inlet valve 32, the second material inlet valve 46, the mixing chamber outlet valve 29, to the first valve 101 and/or to the temporary storage chamber inlet valve 75, depending upon the configuration of the assembly 5, to move from the open configuration to the closed configuration, such that fluid will not be able to flow from the mixing chamber 25 into the temporary storage chamber 65. At this point, the first transfer step is complete. In FIG. 5C, such signals may be transmitted to the three-way valve 140 to move from the first position to the closed position, such that fluid will not be able to flow from the mixing chamber 25 into the temporary storage chamber 65. The three-way valve 140 may be in the closed position such that both the first pipe 141, the second pipe 142, and the third pipe 143 are misaligned and are temporarily not in direct fluid communication with the first transfer channel 181, the mixing chamber 25, the temporary storage chamber 65, the second transfer channel 185, and the dispensing chamber 85. As shown in FIG. 5C, the piston pump 165 may be in a position where the piston pump plate 170 is disposed at any distance between the first wall 72 and the second wall 73.

FIG. 5D shows a non-limiting example of the assembly 5 undergoing the second transfer step when the fluid composition 60 is transferred from the temporary storage chamber 65 into the dispensing chamber 85. Signals may be transmitted to the temporary storage chamber outlet valve 76, to the second valve 121, to the dispensing chamber inlet valve 90, and/or to the dispensing chamber outlet valve 91, depending upon the configuration of the assembly 5, to move from the closed configuration to the open configuration, such that the fluid composition 60 will be able to flow from the temporary storage chamber 65 into the dispensing chamber 85. In FIG. 5D, such signals may be transmitted to cause the three-way valve 140 to move from the closed position to the second position, such that fluid will be able to flow from the temporary storage chamber 65 into the dispensing chamber 85. The three-way valve 140 may be in the open configuration such that both the first pipe 141 and the third pipe 143 are aligned and are in fluid communication with the second transfer channel 185, the temporary storage chamber 65, and the dispensing chamber 85. However, it is contemplated that any such combination of the pipes 141, 142, 143, that may enable fluid communication between the temporary storage chamber 65 and the dispensing chamber 85 may occur. Once the corresponding valves are in the open configuration, a signal may be transmitted to cause a servo motor to initiate activation of a second motive force device to impart positive pressure onto the temporary storage chamber 65. The second motive force device may be any such device known to one skilled in the art that can create a pressure differential between the temporary storage chamber 65 and the dispensing chamber 85 such that fluid will flow in the direction of the fluid flow path 20 from the temporary storage chamber 65 into the dispensing chamber 85. In FIG. 5D, the second motive force device is a piston pump 165. A signal may be transmitted to a servo motor to initiate movement, or a dispensing stroke, of the piston pump 165. The dispensing stroke of the piston pump 165 may be when the piston pump 165 is moved in a direction such as to impart a positive pressure on the temporary storage chamber 65 by creating a corresponding pressure differential. In FIG. 5D, the piston pump 165 is moving in a direction away from the first wall 72 towards the second wall 72, and in doing so, the temporary storage chamber 65 shortens in length and decreases in volume. This decrease in volume acts to provide a positive pressure to the temporary storage chamber 65. As the temporary storage chamber 65 is in fluid communication with the dispensing chamber 85 and as all of the valves disposed between the temporary storage chamber 65 and the dispensing chamber 85 are in the open configuration, the second transfer step will cause the fluid composition 60 to flow out of the temporary storage chamber 65 into the dispensing chamber 85 at a second rate of flow. As shown in FIG. 5D, the mixed fluid composition 60 may be transferred, or suctioned, from the temporary storage chamber 65 to the dispensing chamber as passing through the three-way valve 140. During the second transfer step, the fluid composition 60 may flow through the dispensing chamber 85 and be dispensed, ultimately exiting the assembly 5, through the nozzle 95 attached to or a part of the dispensing chamber 85.

Figure 5E:
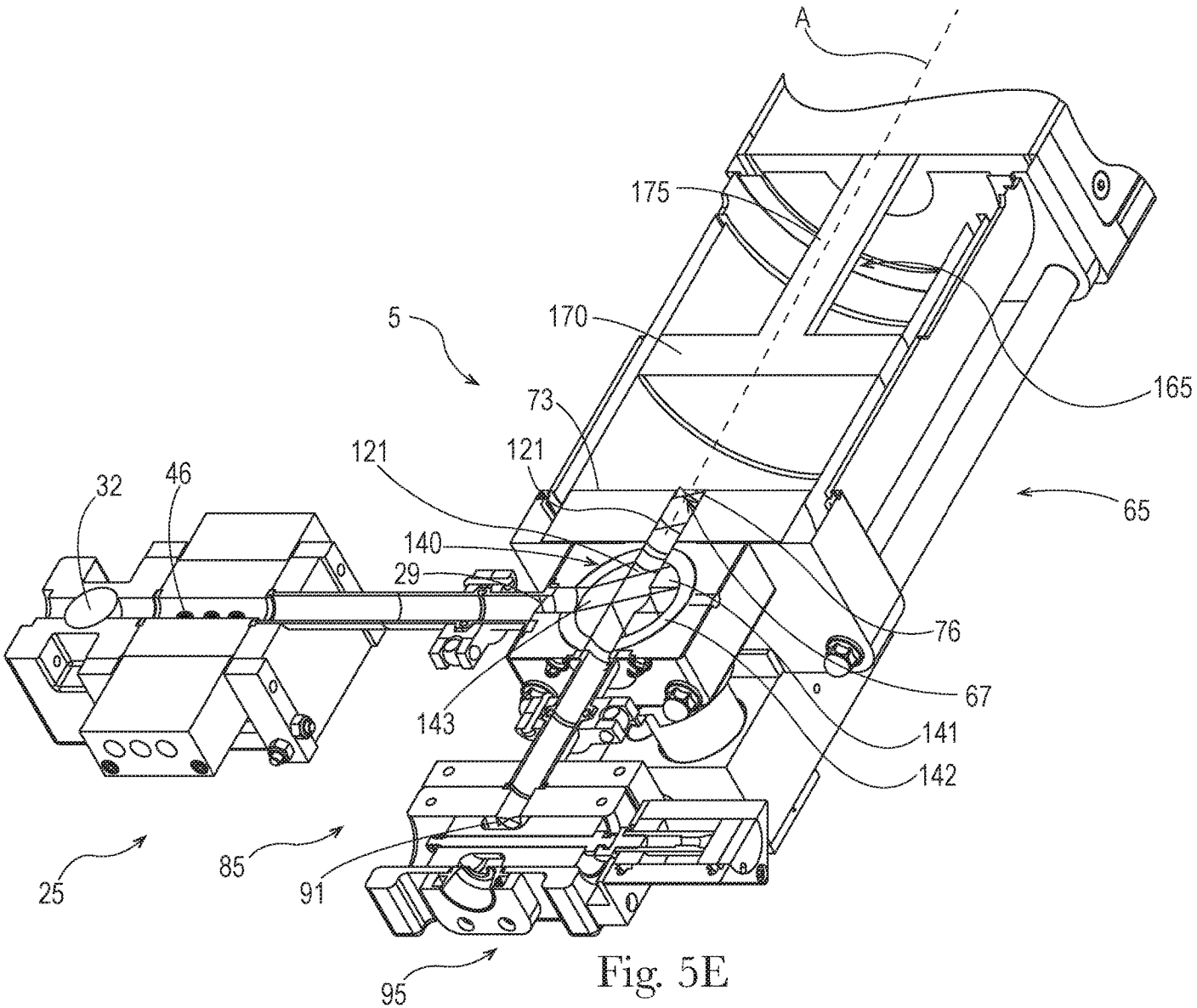
FIG. 5E is an isometric cross-sectional view taken along the line 5-5 of FIG. 4 of a container filling assembly upon completion of a second transfer step and before the start of a subsequent filling cycle, wherein the fluid composition dispensed is less than the fluid composition within a temporary storage chamber for multiple iterations of a second transfer step.
Figure 5F:
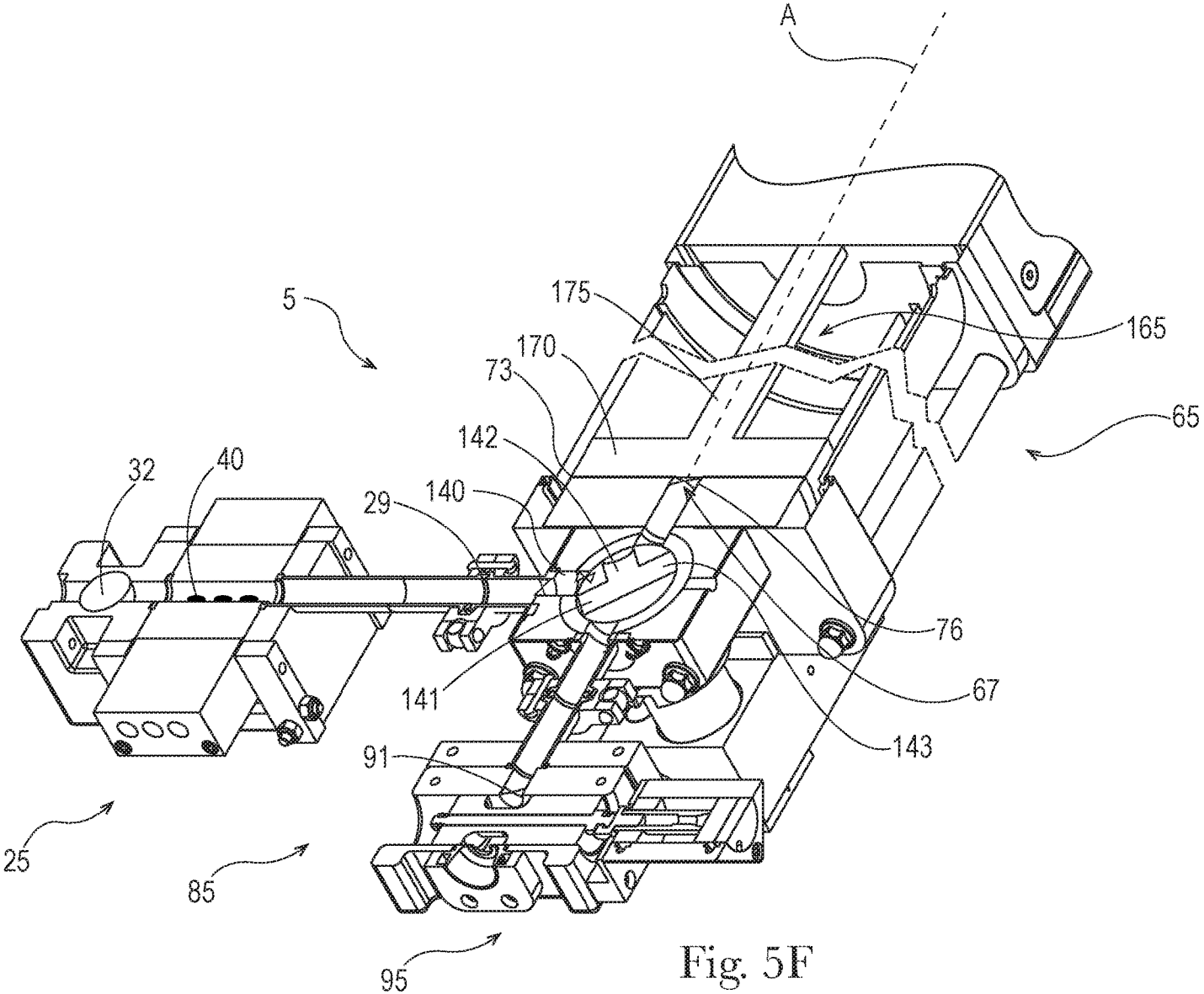
FIG. 5F is an isometric cross-sectional view taken along the line 5-5 of FIG. 4 of a container filling assembly upon completion of a second transfer step and before the start of a subsequent filling cycle, wherein the fluid composition dispensed is equal to the fluid composition within a temporary storage chamber for one iteration of a second transfer step.

FIGS. 5E and 5F show non-limiting examples of the assembly 5 upon completion of the second transfer step. Once the desired container volume $V_5$ has been transferred out of the temporary storage chamber 65 during the second transfer step, a signal may be transmitted to cause a servo motor to stop movement of the second motive force device, here in FIG. 5E, the piston pump 165. During a filling cycle, the assembly 5 may fill one container 8 or multiple containers 8. When the assembly 5 fills one container 8, one iteration of the second transfer step occurs. When the assembly 5 fills more than one container 8, more than one iteration of the second transfer step occurs. FIG. 5E shows a non-limiting example of when more than one container 8 is filled during the filling cycle. FIG. 5F shows a non-limiting example of when only one container 8 is filled during the filling cycle or when all of the fluid composition 60 within the temporary storage chamber 65 has been transferred from the temporary storage chamber 65 into the dispensing chamber 85.

To complete an iteration of the second transfer, signals may be transmitted to the temporary storage chamber outlet valve 76, to the second valve 121, to the dispensing chamber inlet valve 90, and/or to the dispensing chamber outlet valve 91, depending upon the configuration of the assembly 5, to move from the open configuration to the closed configuration, such that the fluid composition 60 will be not be able to flow from the temporary storage chamber 65 into the dispensing chamber 85. In FIGS. 5E and 5F, a signal may be transmitted to a drive to cause the three-way valve 140, to move from the second position to the closed position, such that fluid will be unable to flow from the temporary storage chamber 65 into the dispensing chamber 85. The three-way valve 140 may be in the closed position such that both the first pipe 141, the second pipe 142, and the third pipe 143 are misaligned and are temporarily not in direct fluid communication with the temporary storage chamber 65, the second transfer channel 185, and the dispensing chamber 85. It is contemplated that even after the second valve 121 is in the closed configuration, or here, the three-way valve 140 is in the closed position, fluid composition 60 may still be traveling through the dispensing chamber 85 and through the nozzle 95 ultimately into the container 8 being filled.

FIG. 5E shows a non-limiting example of when the assembly 5 undergoes more than one iteration of the second transfer step during a single filling cycle. When there are multiple containers 8 to be filled, some fluid composition 60 may remain within the temporary storage chamber 65 for a subsequent second transfer step. This may occur when the adjusted volume $V_2$ and the desired volume of the filling cycle are greater than the container desired volume $V_5$. Fluid composition 60 may remain within the temporary storage chamber 65 and each of the chamber outlet valve 76, the second valve 121, the dispensing chamber inlet valve 90, and/or to the dispensing chamber outlet valve 91, is in the closed configuration. As shown in FIG. 5E, the second motive force device, here the piston pump 165, has stopped movement. As shown, the piston pump plate 170 is at a position between the first wall 72 and the temporary storage chamber second wall 73. The piston pump plate 170 may be at a point between the first wall 72 and the second wall 73 upon completion of an iteration of the second transfer step when the desired container volume $V_5$ is less than the total quantity of fluid composition 60 within the temporary storage chamber 65.

FIG. 5F shows the piston pump plate 170 flush against the temporary storage chamber first wall 72. The piston pump plate 170 may be flush against the first wall 72 upon completion of the second transfer step when all of the desired quantity of fluid composition 60 of the filling cycle has been dispensed from the temporary storage chamber 65. This may occur when the summation of each container 8 to be filled's desired container volume $V_5$ equals the adjusted volume $V_3$ within the temporary storage container 65. During the second transfer step, it is contemplated that the piston pump plate 170 also cleans the temporary storage chamber side walls 74. It is contemplated that even after the second valve 121 is in the closed configuration, or here, the three-way valve 140 is in the closed position, fluid composition 60 may still be traveling through the dispensing chamber 85 and through the nozzle 95 ultimately into the container 8 being filled. However, once all of the desired quantity of fluid composition 60 of the filling cycle has been dispensed and has exited from the assembly 5 into the one or multiple containers 8, the assembly may return to the configuration as shown in FIG. 5A, wherein each of the valves is in the closed configuration and the assembly 5 is ready for initiation of a second filling cycle.

Figure 6:
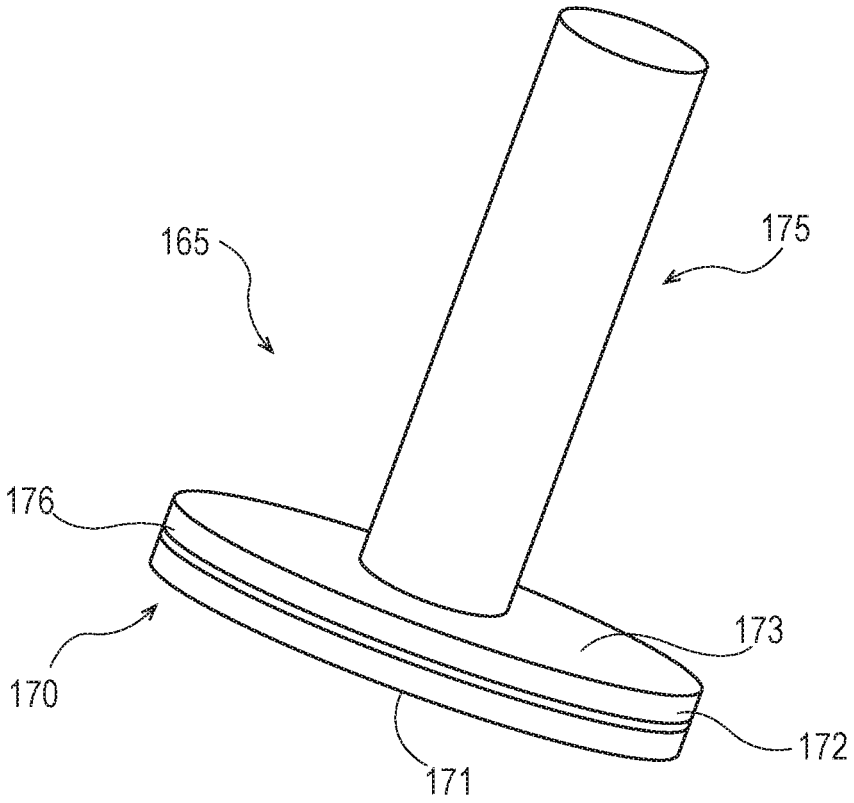
FIG. 6 is an isometric view of a non-limiting piston pump.
Figure 7A:
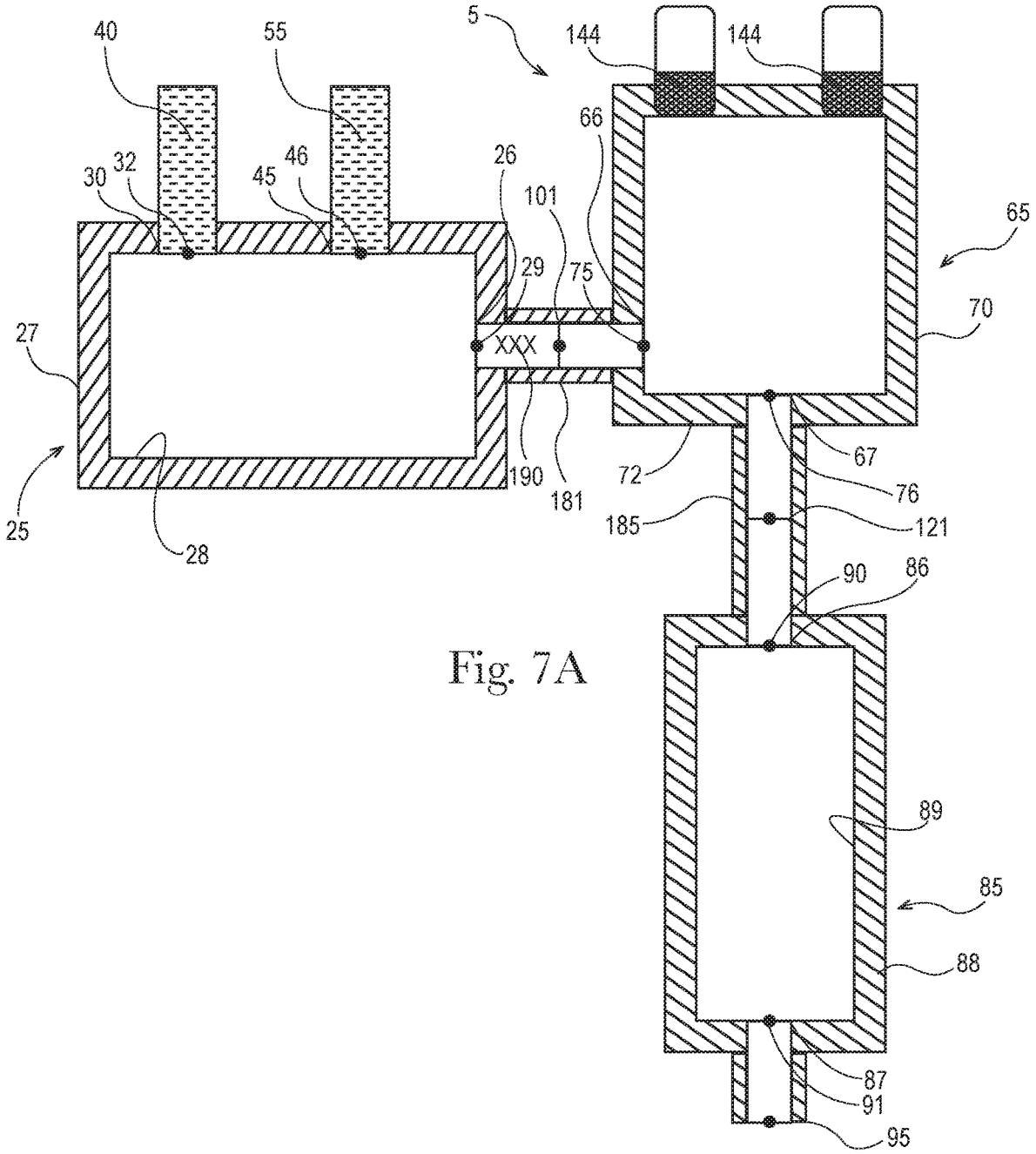
FIG. 7A is a cross-sectional view of a container filling assembly having one or more air pumps before the start of a filling cycle.
Figure 7B:
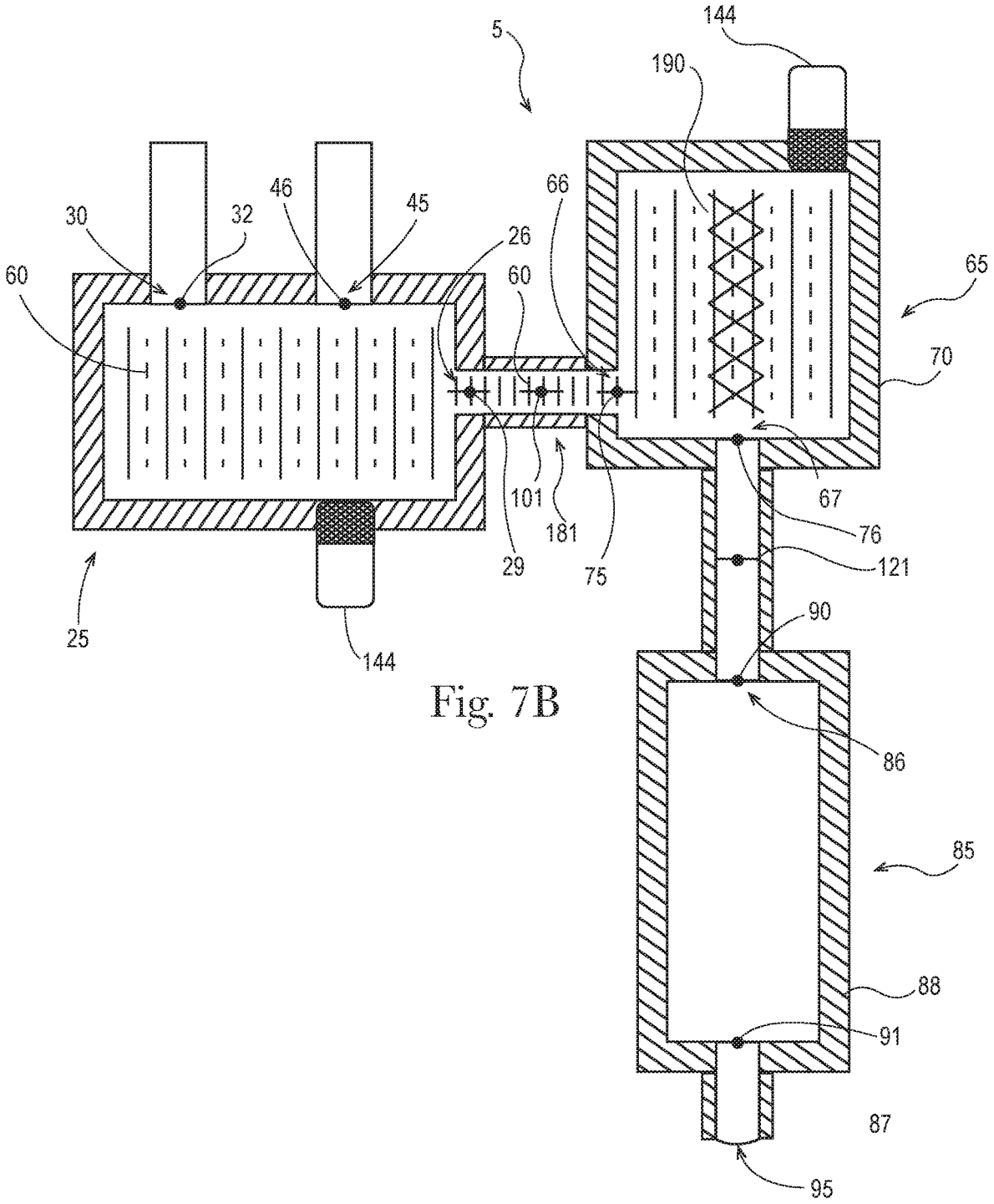
FIG. 7B is a cross-sectional view of a container filling assembly having one or more air pumps undergoing a first transfer step.
Figure 7C:
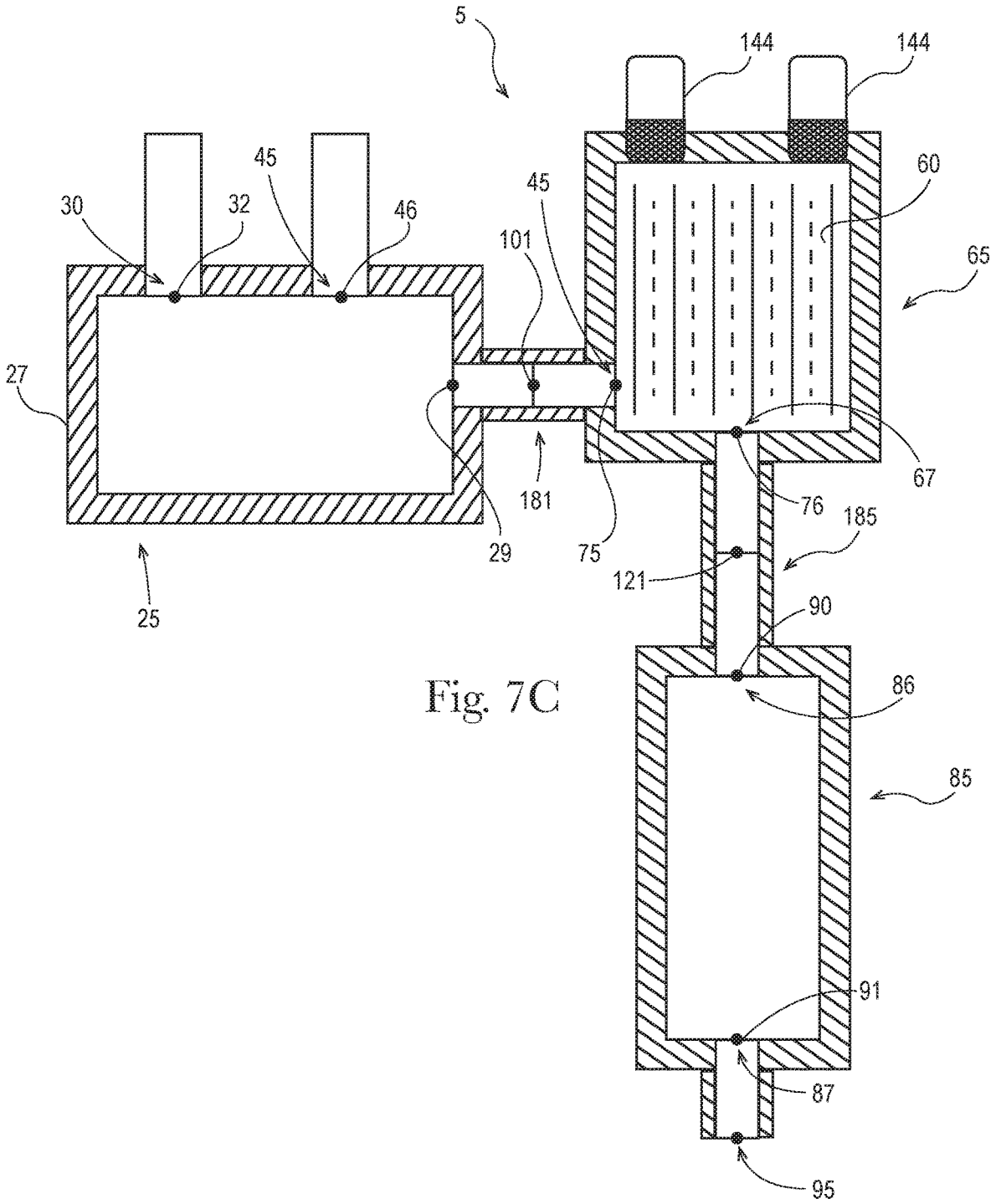
FIG. 7C is a cross-sectional view of a container filling assembly having one or more air pumps upon completion of a first transfer step and before the start of a second transfer step.
Figure 7D:
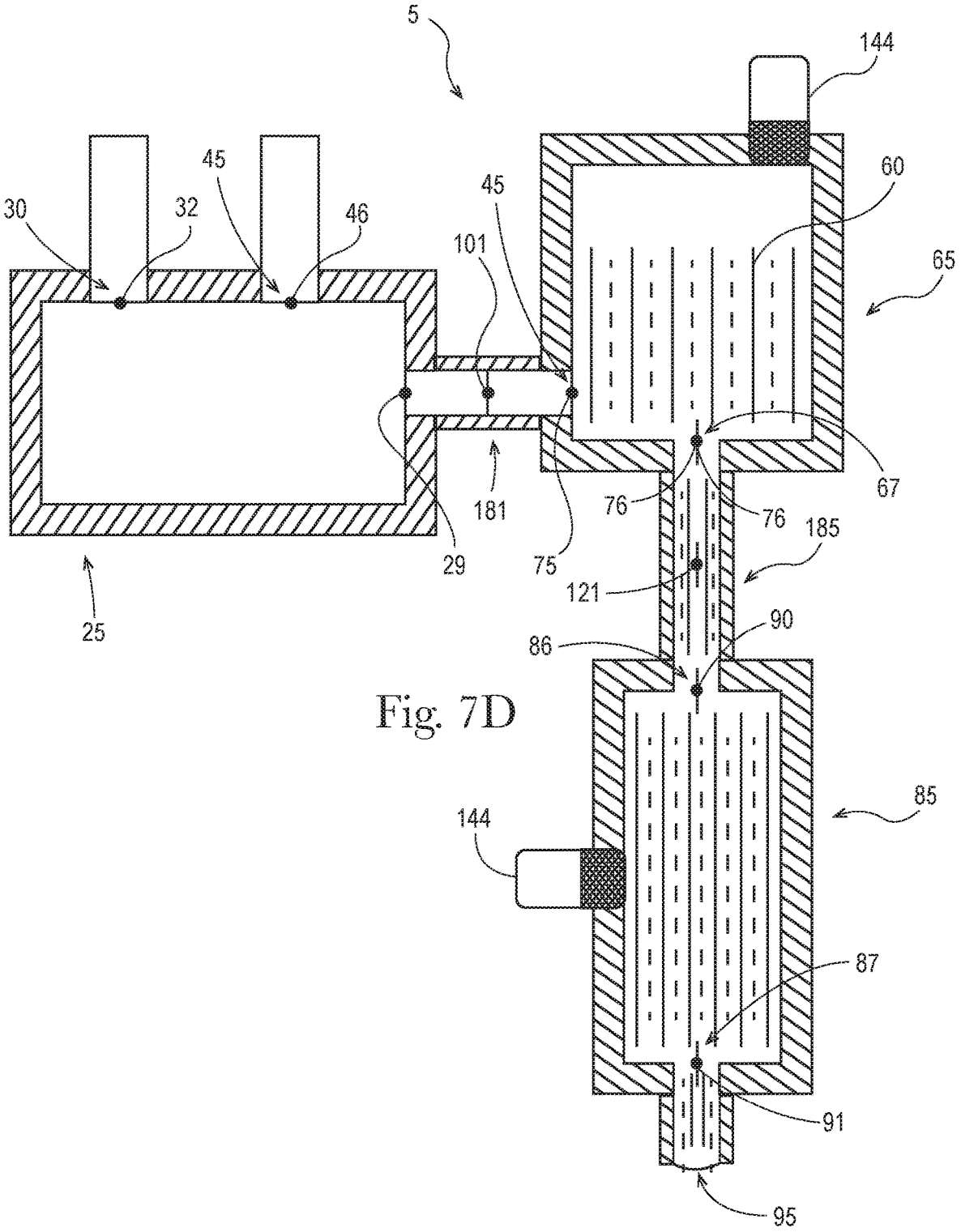
FIG. 7D is a cross-sectional view of a container filling assembly having one or more air pumps undergoing a second transfer step.
Figure 7E:
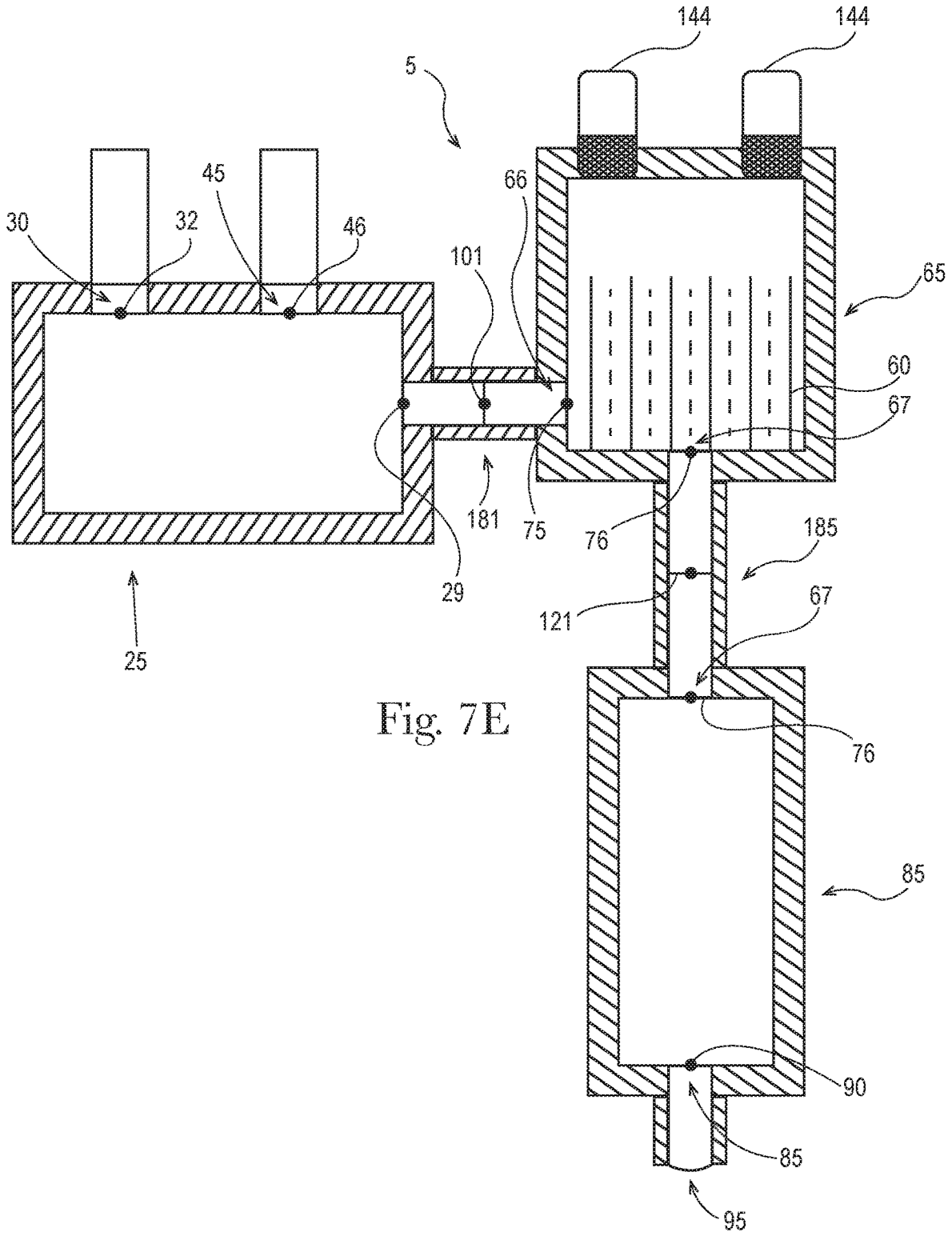
FIG. 7E is a cross-sectional view of a container filling assembly having one or more air pumps upon completion of a second transfer step and before the start of a subsequent filling cycle, wherein the fluid composition dispensed is less than the fluid composition within a temporary storage chamber for multiple iterations of a second transfer step.
Figure 7F:
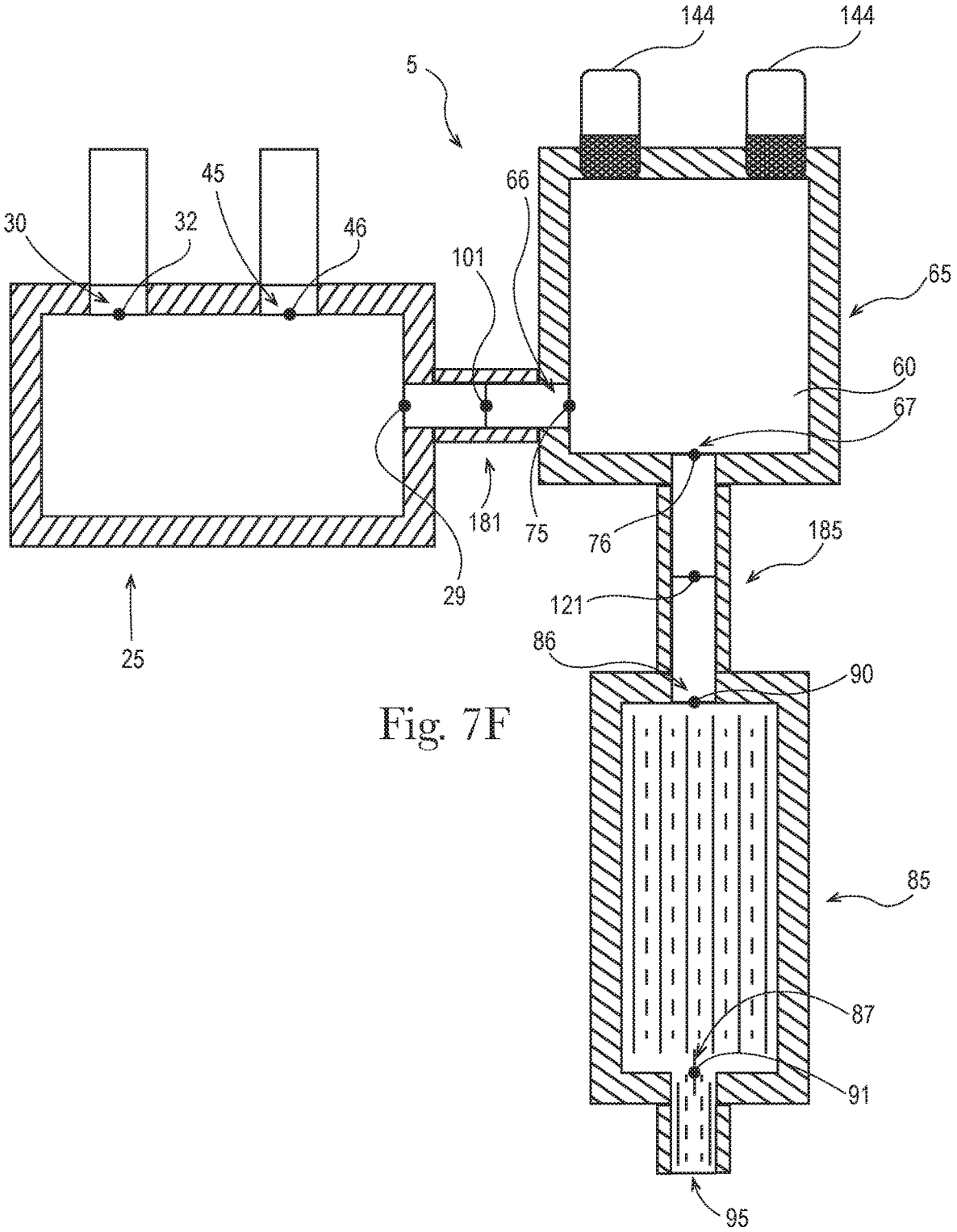
FIG. 7F is a cross-sectional view of a container filling assembly having one or more air pumps upon completion of a second transfer step and before the start of a subsequent filling cycle, wherein the fluid composition dispensed is equal to the fluid composition within a temporary storage chamber for one iteration of a second transfer step.

FIG. 6 shows a non-limiting example of a piston pump 165. The piston pump 165 may comprise a piston pump shaft 175 and a piston pump plate 170. The piston pump plate 170 may have a piston pump plate back surface 173, an opposing piston pump plate front surface 171, and a piston pump plate outer border 172 extending from and connecting the piston pump plate back surface 173 to the piston pump front surface 171. The piston pump shaft 175 may be attached to the piston pump plate back surface 173. The piston pump plate front surface 171 may face the temporary storage chamber second wall 73. As shown in FIG. 6, the piston pump plate 170 may be of cylindrical shape, however, one skilled in the art would know that the shape of the piston pump plate 170 is not so limited. The piston pump plate 170 may be of any shape known to one skilled in the art to be slideably movable about the temporary storage housing inner surface 71 such that fluid composition 60 cannot flow between the piston pump plate 170 and the temporary storage chamber housing inner surface 71. The shape may depend upon, but is not limited to, the shape of the temporary storage chamber housing 70.

The assembly 5 may also be self-cleaning. As a pressure device such as a piston pump 165 moves downward for the step of transferring the fluid composition 60 from the temporary storage chamber 65, (as shown in FIG. 5D) piston pump plate 170 may pushed all of the fluid composition 60 out of the temporary storage chamber 65 such that minimal residual fluid composition 60 remains on the temporary storage chamber housing inner surface 71. The piston pump plate 170 and piston pump plate outer border 172 may be made of any material known to one skilled in the art to push the fluid composition 60 from the temporary storage chamber housing inner surface 71. Although the cleaning mechanism may comprise a piston pump 165, it is contemplated that the cleaning mechanism may comprise any other physical object known to one skilled in the art for drawing undesired residual fluid out of a space. Other such cleaning objects may include, but are not limited to, pipeline inspection gauges, pressurized air, and pipeline intervention gadgets. Preferably, the cleaning mechanism may comprise any combination of a pressure device, flowing materials during the transfer of fluid composition 60 into the temporary storage chamber step 65, and using a physical object such as a piston pump 165 such that the immediately subsequent filling cycle produces a fluid composition 60 having at or below an acceptable level of contamination.

Mixing Chamber

The mixing chamber 25 may provide a desirable location to add fluids because the fluid flow can be reduced, increased, or stopped in the mixing chamber 25 for a predetermined period of time. This time can allow for addition of the ingredients, mixing and/or residence time for the materials to fully mix or react with each other. Also, the mixing chamber 25 can provide for more accurate addition of materials to the fluid because the specific volume of the fluid in the mixing chamber 25 can be fixed and is less susceptible to variation than an ongoing stream of fluid as in conventional high-speed container filling assemblies such as late-product differentiation assemblies. The mixing chamber 25 may provide a space for the individual materials 40, 55 or the fluid composition 60 to remain when the first valve 101 is in the closed configuration.

The mixing chamber 25 may be a pipe, hollow, line, conduit, channel, duct or tank, or any such chamber known to one skilled in the art to facilitate the convergence of two or more materials. The mixing chamber 25 may be the region or point where mixing may occur. However, it is contemplated that mixing may additionally occur downstream from the mixing chamber 25.

The mixing chamber housing 27 may be of any thickness known to one skilled in the art typically contemplated for chambers of this kind. The mixing chamber housing 27 may be formed of inflexible materials such as, for example, steel, stainless steel, aluminum, titanium, copper, plastic, ceramic, and cast iron. The mixing chamber housing 27 may be comprised of flexible material such as, for example, rubber and flexible plastic. The mixing chamber housing 27 may be formed of any material known to one skilled in the art typically contemplated for forming chambers of this kind.

The mixing chamber 25 may be any desired shape, size or dimension known to one skilled in the art to enable two or more materials to converge to form a mixed fluid composition 60. As shown in the Figures, the mixing chamber 25 may be of cylindrical shape, however, one skilled in the art would know that the shape of the mixing chamber 25 is not so limited. The mixing chamber 25 may be of any shape known to one skilled in the art to enable two or more materials to converge to form a mixed fluid composition 60. Preferably, the mixing chamber 25 may be of a shape such that fluid may flow in a path that is substantially circular in cross-section such that a uniform shear distribution is obtained. The size and dimensions of the mixing chamber 25 may be configured according to, but not limited to, the total desired fluid composition 60 of the filling cycle. As noted above, the mixing chamber 25 may be any desired shape, size, or dimension; however, it may be desirable for the mixing chamber 25 to have a predetermined volume $V_1$. The mixing chamber volume $V_1$ may depend on, but is not limited to, the temporary storage chamber adjusted volume $V_3$ and/or the total desired fluid composition 60 of the filling cycle. The mixing chamber volume $V_1$ may be less than or equal to the temporary storage chamber adjusted volume $V_3$ given that all of the fluid within the mixing chamber 25 will be transferred into the temporary storage chamber 65 within a filling cycle. The mixing chamber volume $V_1$ may be less than the temporary storage chamber adjusted volume $V_3$ when the fluid composition residence time within the mixing chamber is short, such that the entire volume of the fluid composition is not in the mixing chamber at one time during a filling cycle. The mixing chamber volume V 1 may be equal to the temporary storage chamber adjusted volume $V_3$ when the residence time is long enough that the entire volume of the fluid composition can be held in the mixing chamber at one time during a filling cycle.

Without wishing to be bound by theory, the length, cross-sectional area, and/or volume of the mixing chamber 25 are preferably as small as possible taking into consideration the rheological characteristics and desired transformation of the fluid composition 60. Having the length, cross-sectional area, and/or volume of the mixing chamber 25 as small as known by one skilled in the art given the above considerations may provide the benefit of minimizing risk of cross-contamination between successive filling cycles. Preferably, the length and/or cross-sectional area of the mixing chamber 25 is large enough to house a mixer 190. It may be desirable for the cross-sectional area of the mixing chamber 25 to be less than 100% of the mixing chamber length $L_1$, less than 75% of the mixing chamber length $L_1$, or less than 50% of the mixing chamber length $L_1$. It may be desirable for the cross-sectional area of the mixing chamber 25 to be less than 5% of the mixing chamber length $L_1$ such the mixing chamber 25 may have a mixer 190, such as a static mixer, within the mixing chamber 25 at a 20:1 length to diameter ratio.

The first and second material inlet orifices 30, 45 may be openings through which materials may enter into the mixing chamber 25. It should be understood that the container filling assembly 5 is not limited to two material inlet orifices, but may comprise any number of material inlet orifices each orifice in fluid communication with a respective source of a material, depending upon the different materials desired to be used. The first material inlet orifice 30 and the second material inlet orifice 45 may be of any size and shape necessary to enable the flow of the respective materials 40, 55 into the mixing chamber 25. The size and shape of the first material inlet orifice 30 and the second material inlet orifice 45 may depend on, but are not limited to, the rheological characteristics of the first and second materials 40, 55, and the first rate of flow.

The mixing chamber outlet orifice 26 may be an opening through which fluid, either material 40, 55 or mixed fluid composition 60, may exit the mixing chamber 25. The mixing chamber outlet orifice 26 may be of any size and shape necessary to enable the material 40, 55 or mixed fluid composition 60 to exit the mixing chamber 25. The size and shape of the mixing chamber outlet orifice 26 may depend on, but are not limited to, the rheological characteristics of the material 40, 55 or mixed fluid composition 60, and the first rate of flow.

The first material inlet orifice 30 and the second material orifice 45 may be coplanar. The first and second material inlet orifices 30, 45 may be disposed adjacent each other. The first and second material inlet orifices 30, 45 may be disposed opposite each other. The first and second material inlet orifices 30, 45 may be disposed concentric each other. The first material inlet orifice 30 may be further upstream on the fluid flow path 20 than the second material inlet orifice 45. However, the configuration of the first and second material inlet orifices 30, 45 is not so limited. The first material inlet orifice 30 and the second material inlet orifice 45 may be positioned relative each other in any configuration necessary to enable convergence of the materials 40, 55 to form the fluid composition 60. The configuration of the first and second material inlet orifices 30, 45 relative each other may depend upon, but is not limited to, the length $L_1$ of the mixing chamber 25, the rheological characteristics of the first and second materials 40, 55, and the first rate of flow.

The first material inlet orifice 30 and the second material orifice 45 may both be further upstream on the fluid flow path 20 than the mixing chamber outlet orifice 26 such that the fluid flow path 20 begins in the mixing chamber 25 when two or more materials 40, 55 converge to form a mixed fluid composition 60 and the fluid composition 60, or the materials 40, 55, may flow down the fluid flow path 20 out of the mixing chamber 25 by way of the mixing chamber outlet orifice 26.

Temporary Storage Chamber

The temporary storage chamber 65 may be a pipe, hollow, line, conduit, channel, duct or tank, or any such chamber known to one skilled in the art to facilitate the holding of the fluid composition 60 and to enable the adjusting mechanism, such as a pressure device like a piston pump 165, to act upon the temporary storage chamber 65 to cause the fluid composition 60 to change from a first rate of flow to a second rate of flow.

The temporary storage chamber 65 may be located downstream of the mixing chamber 25 and upstream of the dispensing chamber 85. As the temporary storage chamber 65 acts as a chamber in which the fluid composition 60 may change from a first flow rate to a second flow rate, it is beneficial to dispose the temporary storage chamber 65 in between the mixing chamber 25 and the dispensing chamber 85. Furthermore, having the mixing chamber 25 upstream of the temporary storage chamber 65 and the temporary storage chamber 65 upstream of the dispensing chamber 85 may provide the benefit that any additional mixing necessary for the fluid composition 60 may be accomplished in the temporary storage chamber 65 as the fluid composition 60 is moved through the pipes and channels and then further in the dispensing chamber 85. In this regard, having a mixer 190 within the mixing chamber 25 may provide the benefit of mixing the various materials 40, 55 through use of a mixer 190, and then any additional mixing necessary for the fluid composition 60 may be accomplished in the temporary storage chamber 65 as the fluid composition 60 is moved through the pipes and channels and then further in the dispensing chamber 85, which may also have a mixer 190.

The temporary storage chamber housing 70 may be of any thickness known to one skilled in the art typically contemplated for chambers of this kind. The temporary storage chamber housing 70 may be formed of inflexible materials such as, for example, steel, stainless steel, aluminum, titanium, copper, plastic, and cast iron. The temporary storage chamber housing 70 may be comprised of flexible material such as, for example, rubber, ceramic, and flexible plastic. The temporary storage chamber housing 70 may be formed of any material known to one skilled in the art typically contemplated for forming chambers of this kind. In a non-limiting example, the temporary storage chamber housing 70 may be of a flexible rubber and may expand when a first motive force device 145 acts upon the temporary storage chamber 65 to then fill with fluid; and then contract when a second motive force device 155 acts upon the temporary storage chamber 155.

The temporary storage chamber 65 may be any desired shape, size or dimension known to one skilled in the art to enable the fluid composition 60 to change from a first rate of flow to a second rate of flow, wherein the second rate of flow is independently variable of the first rate of flow. The temporary storage chamber 65 may be of cylindrical shape, however, one skilled in the art would know that the shape of the temporary storage chamber 65 is not so limited. Preferably, the temporary storage chamber 65 may be of a shape such that fluid may flow in a path that is substantially circular in cross-section. The size and dimensions of the temporary storage chamber 65 may be configured according to, but not limited to, the total desired volume of the filling cycle. As noted above, the temporary storage chamber 65 may be any desired shape, size, or dimension; however, the temporary storage chamber 65 will have a maximum volume $V_2$ which may be the limit of which the temporary storage chamber 65 may expand. The temporary storage chamber maximum volume $V_2$ may be greater than or equal to the mixing chamber volume V 1 because all of the fluid within the mixing chamber 25 will be transferred into the temporary storage chamber 65 within a filling cycle.

The temporary storage chamber maximum volume $V_2$ may be greater than or equal to the temporary storage chamber adjusted volume $V_3$. The temporary storage chamber maximum volume $V_2$ is greater than or equal to the temporary storage chamber adjusted volume $V_3$ because it is the maximum volume the temporary storage chamber 65 can be. The temporary storage chamber maximum volume $V_2$ may be greater than or equal to the dispensing chamber volume $V_4$ because the dispensing chamber 85 need not hold all of the fluid composition 60 transferred from the temporary storage chamber 65 at the same time. The fluid composition 60 may flow into the dispensing chamber 85 and directly out of the nozzle 95. The filling cycle may comprise more than one iteration of the second transfer step. The container desired volume $V_5$, is less than the temporary storage chamber adjusted volume $V_3$ when there is more than one iteration of the second transfer step.

Without wishing to be bound by theory, the length, cross-sectional area, and/or volume of the temporary storage chamber 65 are preferably as small as possible as necessary given the rheological characteristics and rate of flow of the fluid to maintain the minimum resolution and accuracy for smaller fills, or for container desired volumes $V_5$. Having the length, cross-sectional area, and/or volume of the temporary storage chamber 65 as small as known by one skilled in the art given the above considerations may provide the benefits of dosing accuracy, having less surface area to clean, and not taking up as much space. It may be desirable for the cross-sectional area of the temporary storage chamber 65 to be less than 200% of the temporary storage chamber length $L_2$, preferably less than 100% of the temporary storage chamber length $L_2$, or more preferably less than 50% of the temporary storage chamber length $L_2$. The cross-sectional area of the temporary storage chamber 65 being less than 200%, less than 100%, or less than 50% of the temporary storage chamber length $L_2$ may be beneficial because, without wishing to be bound by theory, it is believed that the greater the length to distance ratio of the temporary storage chamber 65, the higher the resolution a servo-driven pump must achieve in terms of dosing accuracy.

The temporary storage chamber inlet orifice 66 may be an opening through which the fluid composition 60, or an individual material 40, 55, may enter into the temporary storage chamber 65. The temporary storage chamber outlet orifice 67 may be an opening through which the fluid composition 60 may exit the temporary storage chamber 65. The temporary storage chamber inlet orifice 66 may be of any size and shape necessary to enable the flow of the fluid composition 60, or an individual material 40, 55, into the temporary storage chamber 65. The temporary storage chamber outlet orifice 67 may be of any size and shape necessary to enable the flow of the fluid composition 60 out of the temporary storage chamber 65. The size and shape of the temporary storage chamber inlet orifice 66 may depend on, but are not limited to, the rheological characteristics of the fluid composition 60 and the first rate of flow. The size and shape of the temporary storage chamber outlet orifice 67 may depend on, but are not limited to, the rheological characteristics of the fluid composition 60 and the second rate of flow. The temporary storage chamber inlet orifice 66 may be upstream the temporary storage chamber outlet orifice 67.

The temporary storage chamber inlet orifice 66 may be disposed orthogonal the temporary storage chamber outlet orifice 67, as shown in the Figures, such that the fluid entering the temporary storage chamber 65 is sufficiently separated by distance from where fluid exits the temporary storage chamber 65. The temporary storage chamber inlet orifice 66 may be disposed on a different wall than the temporary storage chamber outlet orifice 67, as shown in the Figures, which may provide the benefit of utilizing more space of the temporary storage chamber housing 70. The temporary storage chamber inlet orifice 66 and the temporary storage chamber outlet orifice 67 may be disposed relative each other any distance and location that would enable the assembly to perform its functions. It is contemplated that one orifice may act as both the temporary storage chamber inlet 66 during the first transfer step and may act as the temporary storage chamber outlet 67 during the second transfer step. Such a configuration is shown in FIGS. 5A-5F. This configuration may provide the benefit of using fewer machine components and taking up less space if spatial constraints are of particular consideration.

Dispensing Chamber

The dispensing chamber 85 may be a pipe, hollow, line, conduit, channel, duct or tank, or any such chamber known to one skilled in the art to facilitate the flow of a fluid composition 60 out of an assembly 5. The dispensing chamber 85 may be a separate chamber from a filling nozzle 85 or, alternatively, the dispensing chamber 85 may be a conventional filling nozzle 95.

The dispensing chamber housing 88 may be of any thickness known to one skilled in the art typically contemplated for chambers of this kind. The dispensing chamber housing 88 may be formed of inflexible materials such as, for example, steel, stainless steel, aluminum, titanium, copper, plastic, ceramic, and cast iron. The dispensing chamber housing 88 may be comprised of flexible material such as, for example, rubber and flexible plastic. The dispensing chamber housing 88 may be formed of any material known to one skilled in the art typically contemplated for forming chambers of this kind.

The dispensing chamber 85 may be any desired shape, size or dimension known to one skilled in the art to enable to facilitate the flow of a fluid composition 60 out of an assembly 5. The dispensing chamber 85 may be of cylindrical shape, however, one skilled in the art would know that the shape of the dispensing chamber 85 is not so limited. Preferably, the dispensing chamber 85 may be of a shape such that fluid may flow in a path that is substantially circular in cross-section, which can provide for improved filling operation into the container. The size and dimensions of the dispensing chamber 85 may be configured according to, but not limited to, the desired volume of the filling cycle and/or the container desired volume $V_5$. The dispensing chamber volume $V_4$ may be greater than, less than, or equal to the temporary storage chamber adjusted volume $V_3$. The dispensing chamber 85 need not hold all of the fluid composition 60 transferred from the temporary storage chamber 65 at the same time. The fluid composition 60 may flow into the dispensing chamber 85 and directly out of the nozzle 95. The fluid composition 60 may be transferred to the dispensing chamber 85 in more than one iteration of the second transfer step. When this occurs, the container desired volume $V_5$, may be less than the temporary storage chamber adjusted volume $V_3$.

Without wishing to be bound by theory, the length, cross-sectional area, and/or volume of the dispensing chamber 85 are preferably as small as possible taking into consideration the rheological characteristics and second rate of flow of the fluid. Having the length, cross-sectional area, and/or volume of the dispensing chamber 85 as small as known by one skilled in the art given the above considerations may provide the benefit of minimizing risk of cross-contamination between successive filling cycles. Preferably, the length and/or cross-sectional area of dispensing chamber 85 may be large enough to house a mixer 190. It may be desirable for the cross-sectional area of the dispensing chamber to be less than 100% of the dispensing chamber length $L_3$, less than 75% of the dispensing chamber length $L_3$, or less than 50% of the dispensing chamber length $L_3$. It may be desirable for the cross-sectional area of the dispensing chamber 85 to be less than 5% of the dispensing chamber length $L_3$ such the dispensing chamber 85 may have a mixer 190, such as a static mixer, within the dispensing chamber 85 at a 20:1 length to diameter ratio.

The dispensing chamber inlet orifice 86 may be an opening through which the fluid composition 60 may enter into the dispensing chamber 85. The dispensing chamber outlet orifice 87 may be an opening through which the fluid composition 60 may exit the dispensing chamber 85. The dispensing chamber inlet orifice 86 and the dispensing chamber outlet orifice 87 may be of any size and shape necessary to enable the flow of the fluid composition 60 into the dispensing chamber 85 and out of the dispensing chamber 85, respectively. The size and shape of the dispensing chamber inlet orifice 86 and of the dispensing chamber outlet orifice 87 may depend on, but are not limited to, the rheological characteristics of the fluid composition 60 and the second rate of flow. The dispensing chamber inlet orifice 86 may be upstream the dispensing chamber outlet orifice 87.

Nozzle

Figure 8:
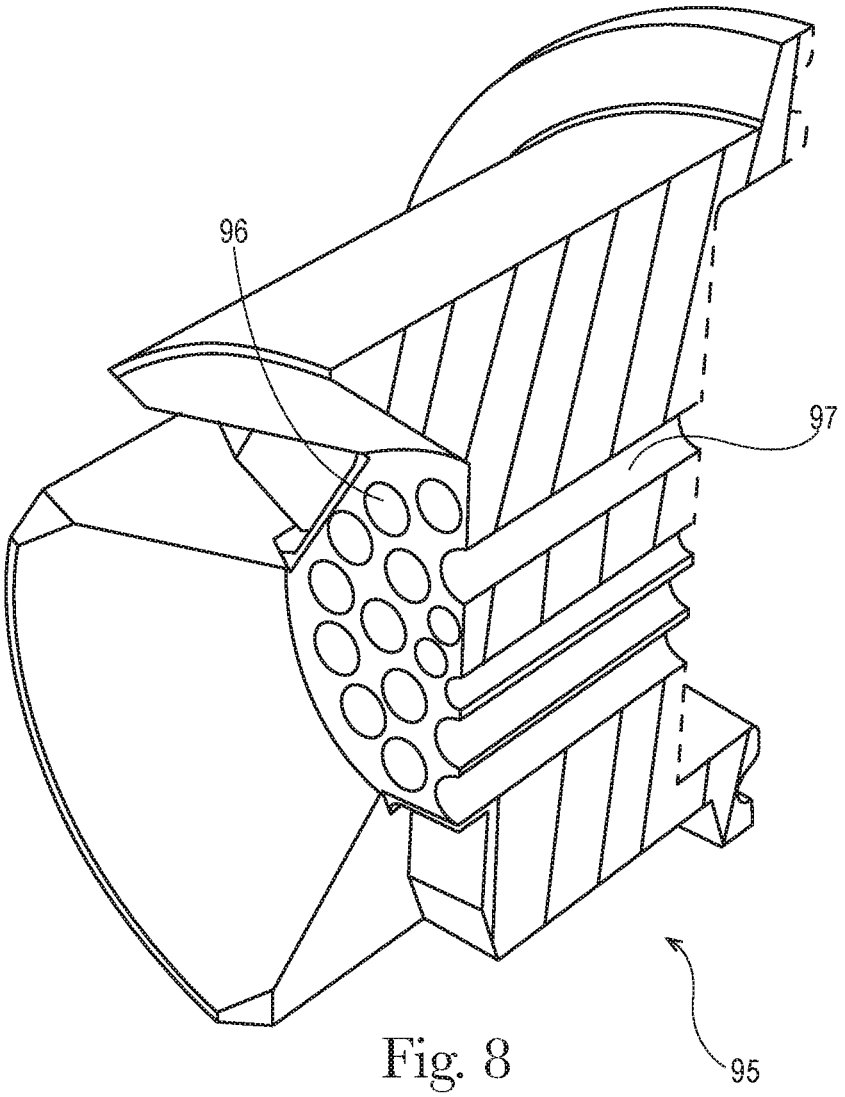
FIG. 8 is a cross-sectional view of a nozzle.

FIG. 8 shows a non-limiting example of a nozzle 95. A spout or other fluid directing or control structure, such as a nozzle 95, may be through which the fluid composition 60 ultimately exits the container filling assembly 5. The nozzle 95 may be disposed adjacent the dispensing chamber 85 and may be part of the dispensing chamber 85 or a separate piece permanently or temporarily fixed thereto. The nozzle 95 may be located adjacent the opening 10 of the container 8 but still completely outside of the container 8 during the filling process, or may be positioned fully or partly within the container 8 through the opening 10. The nozzle 95 may comprise any number of orifices 96 or other openings through which the fluid composition 60 may flow. The orifices 96 may be of such a length to form nozzle passageways 97, or channels, through which the fluid composition 60 may flow. The nozzle orifices 96 or any one or more of the nozzle orifices 96 may be circular in cross-section, but other shapes, numbers of orifices and sizes are contemplated. The nozzle 95 need not be a single nozzle, but may include one or more nozzles that are separate or joined together. The shape and/or orientation of the nozzle 95 may be static. It is also contemplated that the container filling assembly 5 and/or nozzles 95 may be configured such that different nozzles may be used with the container filling assembly 5, allowing the operator to choose between different nozzle types depending on the particular filling operation. The nozzle 95 may also be manufactured as part of the dispensing chamber 85. This can reduce the number of seals needed between parts, which can be especially useful when filling containers with fluids that include ingredients, such as perfumes, that can degrade or compromise seal integrity. Such configurations can also help reduce or eliminate locations where microbes, sediment and/or solids can get trapped.

Valves

For simplicity, the figures only depict certain exemplary types of valves. However, it is to be understood that any suitable valve can be used in the container filling assembly 5. For example, the first valve 101 and the second valve 121 may be ball valves, spool valves, rotary valves, sliding valves, wedge valves, butterfly valves, choke valves, diaphragm valves, gate-type valves, needle pinch valves, piston valves, plug valves, poppet valves and any other type of valve suitable for the particular use intended for the container filling assembly 5. Further, the assembly 5 may include any number of valves and the valves may be the same type, different or a combination thereof. The valves may be any desired size and need not be the same size. Examples of valves that have been found suitable for use in the container filling assembly 5, for example, to fill bottles with soap, such as hand dish soap having a viscosity of around 300 centipoise and liquid laundry detergent having a viscosity of around 600 centipoise, are piston, spool and rotary valves.

The valves in the assembly 5 may include one or more seals to provide a sealing mechanism to ensure that the fluid composition 60 does not seep out of the valve. The seals may be any suitable size and/or shape and may be made from any suitable material. Further, each valve may include any number of seals. Each valve may include one seal or two seals one at each end of each respective valve. A non-limiting example of a suitable seal is an o-ring, such as an extreme chemical Viton Etp O-ring Dash number 13 available from McMaster-Carr.

If piston-type valves are used, the valves may be any suitable size or shape. For example, the first valve 101 may be a cylinder or cylinder-like. The valve may have a cylindrical shape with a portion necked down to allow the fluid to pass around it. Alternatively, the valve may have a cylindrical shape having one or more channels extending through the cylinder, the channel(s) allowing the fluid to pass through it. If three-way type valves are used, the valves may be any suitable size or shape. Further, the valve or any portions of the valves can be made out of any material suitable for the purpose of the valve. For example, the valve may be made out of steel, plastic, aluminum, ceramics, layers of different materials, etc. One embodiment that has been found to be suitable for use with fluids, such as hand dish detergent liquids having viscosities between about 200 and about 6000 centipoise is a ceramic material AmAlOx 68 (99.8% aluminum oxide ceramic) available from Astro Met, Inc, 9974 Springfield Pike, Cincinnati, Ohio. One advantage of ceramic materials is that they can be formed with very close tolerances and may not need additional seals or other sealing structures to prevent fluid from escaping the valve. Reducing the number of seals can also reduce the spaces into which microbes can find their way and live, which can help improve the hygiene of the process. When the assembly 5 comprises a three-way valve 140 such as that shown in FIGS. 5A-5F, the three-way valve 140 may be rotatable between a first position, a second position, and a closed position or the three-way valve 140 may be static throughout the filling cycle.

System of Motive Force and Rates of Flow

The assembly 5 may further pressure devices for creating and controlling the desired rates of flow for the fluid composition 60 to flow through the various chambers in the assembly 5. The pressure devices may be any device capable of providing a motive force to cause the fluid to move throughout the assembly 5.

The system of motive force may comprise a first motive force device in fluid communication with the temporary storage chamber, which may create a first rate of flow for the fluid composition to flow from the mixing chamber into the temporary storage chamber. The system of motive force may comprise a second motive force device in fluid communication with the temporary storage chamber, which may create a second rate of flow for the fluid composition to flow from the temporary storage chamber into the dispensing chamber and to ultimately be dispensed from the assembly. The mixing chamber and the dispensing chamber are not in direct fluid communication such that the first rate of flow and second rate of flow are independent of each other.

The second motive force device may be configured to provide pressure to enable the fluid composition to flow at a pre-determined second rate of flow. As such, an adjusting mechanism, such as a piston pump, can act as a second motive force device. Considerations to determine the pressure differential necessary to create a second rate of flow may include, but are not limited to, the respective rheological characteristics the fluid composition, the transformation of the fluid composition desired to be achieved, and the respective cross-sectional area(s) and length(s) of at least the temporary storage chamber, the second transfer channel, and the dispensing chamber.

The materials may be pressurized or provided at a pressure that is greater than atmospheric pressure. The fluid composition may be pressurized or provided at a pressure that is greater than atmospheric pressure.

Preferably, the first rate of flow may be configured to provide mixing, or a transformation of the materials to form the fluid composition and/or further transformation of the fluid composition, if desired. Preferably, the second rate of flow may be configured to provide further mixing, or a further transformation of the fluid composition, if desired. Preferably, the second rate of flow may be configured to minimize splash-back of the fluid composition, or the surge of fluid towards the filling cycle that can cause the fluid in the container to splash in a direction generally opposite to the direction of filling and often out of the container being filled.

Transfer Channels

The assembly 5 may one or more transfer channels for connecting the various chambers and parts of the assembly 5. The assembly 5 may comprise a first transfer channel 181, operatively connecting the mixing chamber 25 and the temporary storage chamber 65. The assembly 5 may comprise a second transfer channel 185 operatively connecting the temporary storage chamber 65 with the dispensing chamber 85.

The first transfer channel 181 may be, for example, a pipe, and may allow for the fluid composition 60, the first material 40, and/or the second material 55 to flow from the mixing chamber 25 to the temporary storage chamber 65. The second transfer channel 185 may be, for example, a pipe, and may allow for the fluid composition 60 to flow from the temporary storage chamber 65 to the dispensing chamber 85.

The housings of the first transfer channel and the second transfer channel may be of any thickness known to one skilled in the art typically contemplated for channels of this kind and may be formed of inflexible materials such as, for example, steel, stainless steel, aluminum, titanium, copper, plastic, and cast iron or may be formed of flexible material such as, for example, rubber and flexible plastic.

The first transfer channel 181 and the second transfer channel housing 185 may be any desired shape, size or dimension known to one skilled in the art to enable to facilitate the flow of a fluid composition 60 from one chamber to another. The first transfer channel 181 and the second transfer channel 185 may be of cylindrical shape, however, one skilled in the art would know that the shapes of the first transfer channel 181 and the second transfer channel 185 are not so limited. Preferably, the first transfer channel 181 and the second transfer channel 185 may be of a shape such that fluid may flow in a path that is substantially circular in cross-section.

The first transfer channel 181 and the second transfer channel 185 may each have a respective length, volume, and cross-sectional area. Without wishing to be bound by theory, the length, cross-sectional area, and/or volume of the first transfer channel 181 are preferably as small as possible taking into consideration the rheological characteristics and first rate of flow of the fluid. Having the length, cross-sectional area, and/or volume of the first transfer channel 181 and the second transfer channel 185 as small as known by one skilled in the art given the above considerations may provide the benefit of minimizing risk of cross-contamination between successive filling cycles. It is contemplated that when the distance between the mixing chamber outlet orifice 26 and the temporary chamber inlet orifice 66 is so small, or each orifice is adjacent to the other, that there may not be a need for the assembly 5 to have a separate first transfer channel 181. In such circumstance, the mixing chamber outlet orifice 26 and the temporary chamber inlet orifice 66 are joined in such a manner that materials 40, 55 and or the fluid composition 60 are transferred directly from the mixing chamber 25 into the temporary storage chamber 65. It is contemplated that when the distance between the temporary chamber outlet orifice 67 and the dispensing chamber inlet orifice 86 is so small, or each orifice is adjacent to the other, that there may not be a need for the assembly 5 to have a separate second transfer channel 185, with the orifices acting as the first transfer channel 181. In such circumstance, the temporary chamber outlet orifice 67 and the dispensing chamber inlet orifice 86 are joined in such a manner that the fluid composition 60 is transferred directly from the temporary storage chamber 65 into the dispensing chamber 85, with the orifices acting as the second transfer channel 185. The first transfer channel 181 may be continuous as shown in the Figures or may be separated by a valve as shown in FIGS. 5A-5F. The second transfer channel 185 may be continuous as shown in the Figures or may be separated by a valve, as shown in FIGS. 5A-5F.

The first transfer channel inlet orifice 182 may be an opening through which the materials 40, 55 and/or fluid composition 60 may enter into the first transfer channel 181 from the mixing chamber 25. The first transfer channel outlet orifice 183 may be an opening through which the materials 40, 55 and/or fluid composition 60 may exit the first transfer channel 181 into the temporary storage chamber 65. The first transfer channel inlet orifice 182 and the first transfer channel outlet orifice 183 may be of any size and shape necessary to enable the flow of the materials 40, 55 and/or fluid composition 60 into the first transfer channel 181 and out of the first transfer channel 181, respectively. The size and shape of the first transfer channel inlet orifice 182 and the first transfer channel outlet orifice 183 may depend on, but are not limited to, the rheological characteristics of the materials 40, 55, and/or the fluid composition 60, the desired transformation of the fluid composition 60, and the first rate of flow. The first transfer channel inlet orifice 182 may be upstream the first transfer channel outlet orifice 183.

The second transfer channel inlet orifice 186 may be an opening through which the fluid composition 60 may enter into the second transfer channel 185 from the temporary storage chamber 65. The second transfer channel outlet orifice 187 may be an opening through which the fluid composition 60 may exit the second transfer channel 185 into the dispensing chamber 85. The second transfer channel inlet orifice 186 and the second transfer channel outlet orifice 187 may be of any size and shape necessary to enable the flow of the fluid composition 60 into the second transfer channel 185 and out of the second transfer channel 181, respectively. The size and shape of the second transfer channel inlet orifice 186 and the second transfer channel outlet orifice 187 may depend on, but are not limited to, the rheological characteristics of the fluid composition 60, the desired transformation of the fluid composition 60, and the second rate of flow. The second transfer channel inlet orifice 186 may be upstream the second transfer channel outlet orifice 187.

Materials

The materials 40, 55 of the present disclosure may be in the form of raw materials, or pure substances. The materials 40, 55 of the present disclosure may be in the form of a mixture already created further upstream to the assembly 5. The materials may converge to form a mixed fluid composition 60. At least one of the materials 40, 55 must be different than the other materials 40, 55.

Preferably, the fluid compositions formed using the assembly 5 of the present disclosure are selected from the group consisting of a liquid laundry detergent, a gel detergent, a single-phase or multi-phase unit dose detergent, a detergent contained in a single-phase or multi-phase or multi-compartment water soluble pouch, a liquid hand dishwashing composition, a laundry pretreat product, a fabric softener composition, and mixtures thereof.

Preferably, the fluid compositions of the present disclosure may have a viscosity of from about 1 to about 2000 mPa*s at 25° C. and a shear rate of 20 $sec^{-1}$. The viscosity of the liquid may be in the range of from about 200 to about 1000 mPa*s at 25° C. at a shear rate of 20 $sec^{-1}$. The viscosity of the liquid may be in the range of from about 200 to about 500 mPa*s at 25° C. at a shear rate of 20 $sec^{-1}$.

As the fluid compositions 60 are being dispensed into a container 8, it is preferable that the compositions of the present disclosure may be suitable for being contained in a container, preferably a bottle. It should be understood, however, that other types of containers are contemplated, including, but not limited to boxes, cups, cans, vials, single unit dose containers such as, for example soluble unit dose pods, pouches, bags, etc., and that the speed of the filling line should not be considered limiting.

The fluid compositions of the present disclosure may comprise a variety of ingredients, such as surfactant and/or adjunct ingredients. The fluid composition may comprise an adjunct ingredient and a carrier, which may be water and/or organic solvent. The fluid compositions of the present disclosure may be non-homogeneous with regard to the distribution of adjunct ingredient(s) in the composition as contained in the container. Put another way, the concentration of an adjunct ingredient in the composition may not uniform throughout the composition—some regions may have higher concentrations, while other regions may have lower concentrations.

Test Methods

Filling Cycle Method

An assembly according to the present disclosure having a first minor feed, a second minor feed, a major feed, a chamber having a static mixer ("mixing chamber"), another chamber downstream the mixing chamber embodied via a 2-liter servo-driven piston pump ("temporary storage chamber"), and a chamber or passageway through which fluid is dispensed from the temporary storage chamber into the container ("dispensing chamber") is provided. The dispensing chamber may be attached to a nozzle. A three-way valve connects the mixing chamber to the temporary storage chamber and the temporary storage chamber to the dispensing chamber. The assembly is connected to a controller capable of transmitting signals to drives that control the movement of individual components of the assembly (i.e., the open/closing of the major feed, minor feed, three-way valve, and movement of the piston pump).

For each filling cycle iteration, the process of fluid flow throughout the assembly was as follows:

1) Place an empty, transparent container (such as a 1.5 L clear plastic bottle) underneath the dispensing chamber.
2) Fill each minor feed with the appropriate amount of materials; fill the major feed with an appropriate amount of white base detergent.
3) Set the choice of minor feed, the volume of the total mixture, the individual volumes of each of the minor feed(s) and major feed, and the rates of flow electronically in the controller.
4) Open the three-way valve connecting the mixing chamber and the temporary storage chamber.
5) Open the major feed and minor feed(s) (via a one-way valve such that flow is not induced until the piston pump undergoes the suction stroke).

6) Initiate suction stroke of the servo-controlled piston pump such that the suction stroke creates the volume of the temporary storage chamber and initiates flow of the major and minor feed(s) into the mixing chamber. As the temporary storage chamber and the mixing chamber are in fluid communication via the openly positioned valve, flow is induced from the minor feed(s) and major feed into the mixing chamber to the temporary storage chamber. During the transport of major and minor materials, the static mixer in the mixing chamber serves to sufficiently blend the material(s) from the minor feed(s) with the detergent from the major feed into a finished product.
7) Turn the minor feed(s) off while the suction stroke continues to cause flow of detergent from the major feed. This step serves to flush out the material(s) from the minor feed(s) from the mixing chamber such that subsequent filling cycle iterations are without contamination of material(s) from the minor feed(s).
8) Rotate the three-way valve such that fluid communication is halted between the mixing chamber and the temporary storage chamber and fluid communication is opened between the temporary storage chamber and the dispensing chamber.
9) Initiate movement of the piston pump in the direction opposite the suction stroke so as to compress the volume of the temporary storage chamber and thus evacuate the temporary storage chamber of fluid. This step serves to cause fluid to flow from the temporary storage chamber into the dispensing chamber and to be dispensed into the container.
10) Move the container and prepare for subsequent filling cycle iteration, if any.

Delta E (ΔE) Color Difference Test Method

The Delta E (ΔE) Color Difference Test Method measures the delta E (ΔE) of a series of individual samples that are sequentially mixed and prepared to evaluate how well-mixed each sample is and if there is any contamination from previous samples.

At least five samples are prepared according the Filling Cycle Method as discussed herein. Each sample undergoes a separate filling cycle iteration. The first sample ("Sample 1") uses a first colorant/dye in a first minor feed ("Minor Feed 1"). The second sample through fifth sample ("Sample 2", "Sample 3", "Sample 4", and "Sample 5" respectively) use a second colorant/dye in a second minor feed ("Minor Feed 2"). The major feed is filled with white base detergent. The assembly is not rinsed in between each successive filling cycle iteration. An aliquot from each respective container is placed into separate, respective glass vials to create each respective sample.

The glass vials are each respectively placed into a spectrophotometer, such as spectrophotometers manufactured by HunterLab, Reston, Va., U.S.A., and the L*a*b score of at least Samples 1, 2, and 5 is measured according to the manufacturer's instructions. The L*a*b score of Sample 5 is set as the reference control as it is the fourth of four iterations of the second filling cycle using the second minor feed and thus most conservatively does not contain contamination from the first filling cycle using the first minor feed.

For each of Samples 1 and 2, a ΔE is calculated according to the following equation:

$$\Delta E=\sqrt{(L_R-L_S)^2+(a_R+a_S)^2+(b_R-b_S)^2}$$

wherein the subscript R is to the reference control (Sample 5) and the subscript S is to each respective sample of Samples 1 and 2. The L*a*b and ΔE values for Samples 3 and 4 may also be calculated if desired.

EXAMPLES

Example 1: Determination of Contamination Between Subsequently Filled Samples To determine the level of contamination and goodness of mixing between subsequently filled samples individually mixed using the assembly of the present disclosure, five samples were prepared according to the Delta E (ΔE) Color Difference Test Method and the Filling Cycle Method as described hereinabove. In the assembly, a SMX™ static mixer (made commercially available by Sulzer, Winterthur, Switzerland; ¾" diameter, 6 elements) was used. Minor Feed 1 was filled with about 20 mL of red dye premix (1% red dye diluted in water). Minor Feed 2 was filled with about 12 mL of blue dye premix (1% blue dye diluted in water). The Major Feed was filled with about 7 L of white base detergent (white 2× Ultra TIDE® liquid detergent not having any colorant having a ~400 cps high shear viscosity, as made commercially available by The Procter & Gamble Company, Cincinnati, Ohio). For the first filling cycle iteration, 20 mL of Minor Feed 1 material and 730 mL of Major Feed material moved through the mixing chamber into the temporary storage chamber by a suction stroke of the 2 L piston pump creating a rate of flow of approximately 300 mL/s, for a total volume of 750 mL. The 2 L piston pump then moved the materials from the temporary storage chamber into the dispensing chamber and out of the assembly into the container by a dispensing stroke creating a rate of flow of approximately 500 mL/s. The container containing Sample 1 was then moved and a new container was placed beneath the dispensing chamber and nozzle for the next filling cycle iteration. For the second through fifth filling cycle iterations, 3 mL of Minor Feed 2 material and 1497 mL of Major Feed material moved through the mixing chamber into the temporary storage chamber by a suction stroke of the 2 L piston pump creating a rate of flow of approximately 400 mL/s. The 2 L piston pump then moved the materials from the temporary storage chamber into the dispensing chamber and out of the assembly into the container by a dispensing stroke creating a rate of flow of approximately 200 mL/s. The assembly was not rinsed between successive filling cycle iterations and the time between each successive filling cycle iteration was approximately 15 seconds or less. For the Delta E (ΔE) Color Difference Test Method, a HunterLab UltraScan VIS spectrophotometer manufactured by HunterLab (Reston, Va., U.S.A.) was used.

The L*a*b values were then calculated for each of Samples 1, 2, and 5, and the ΔE of Samples 1 and 2 with respect to Sample 5 were calculated and are shown in Table 1.

TABLE 1

L*a*b and ΔE for Colored Samples 1 and 2

| Sample | L* | a* | b* | ΔE |
|---|---|---|---|---|
| Sample 5 | 80.78 | −31.67 | −7.1 | |
| Sample 1 | 59.45 | 59.9 | −13.49 | 57.48 |
| Sample 2 | 81.91 | −18.03 | −4.98 | 6.64 |

Typically, the lower the ΔE, the more similar the sample is to a reference control. A ΔE exceeding 10 is a typical threshold indicative of an unacceptable consumer noticeable difference between two samples. A ΔE of 10 or lower is a typical threshold indicative of an acceptable consumer noticeable difference between two samples. As is shown in by the results in Table 1, the ΔE between Sample 1 (having red dye pre-mix) and Sample 5 (the blue dye pre-mix reference control) was 57.48, above the acceptable consumer threshold of a ΔE of exceeding 10. The ΔE between Sample 2 (the first filling cycle iteration after the red dye pre-mix to have blue dye pre-mix) and Sample 5 was 6.64, falling within the acceptable consumer threshold of a ΔE of 10 and under. As such, Applicant has demonstrated the immediate changeover ability of the assembly to product subsequent finished products of differing materials that fall within the acceptable consumer threshold for contamination, without having to rinse the assembly.

Example 2: Determination of Mixing Capability of the Assembly

To determine the goodness of mixing throughout the final product within a single container, a final product of detergent was prepared according to the Filling Cycle Method as described hereinabove wherein a structuring agent was added as a minor feed material to a detergent not having a structuring agent. The yield stress of sixteen (16) samples taken from the final product was measured and percent relative standard deviation (% RSD) was calculated. The yield stress is indicative of the integrity of the matrix created by the structuring agent being homogeneously dispersed throughout the final product and the % RSD is indicative of the homogeneity of the matrix throughout the container. An $R^2$ value was also calculated for each of the yield stress measurements (rheological data fitted against the Herschel-Bulkley model, as described hereinafter). The $R^2$ is indicative of how sufficiently dispersed the structuring agent is to create a matrix sufficient for the suspension of other materials within a detergent in terms of characterizing the material properties.

In the assembly, a SMX™ static mixer (made commercially available by Sulzer, Winterthur, Switzerland; ¾" diameter, 6 elements) was used. Minor Feed 1 was filled with about 60 mL of THIXCIN® (a structuring agent made commercially available by Rheox, Inc, Hightstown, N.J., USA). Minor Feed 2 was filled with about 3 mL of blue dye premix (1% blue dye diluted in water). The Major Feed was filled with about 2 L of white base detergent not containing a structuring material (white 2× Ultra TIDE® liquid detergent not having any colorant or structuring material having a ~400 cps high shear viscosity, as prepared by The Procter & Gamble Company, Cincinnati, Ohio; wherein a structuring material is that which is known by one skilled in the art for formulating liquid laundry detergents). For the filling cycle iteration, 60 mL of Minor Feed 1 material, 3 mL of Minor Feed 2 material, and 1437 mL of Major Feed material moved through the mixing chamber into the temporary storage chamber by a suction stroke of the 2 L piston pump creating a rate of flow of between about 300 mL/s and about 500 mL/s, for a total volume of 1500 mL. The 2 L piston pump then moved the materials from the temporary storage chamber into the dispensing chamber and out of the assembly into the container by a dispensing stroke creating a rate of flow of approximately 500 mL/s. The final product in the container was then poured into 8 sample jars, each sample jar containing a volume of final product of about 187.5 mL ("Samples A-H").

Each Sample was tested twice (two separate aliquots from same Sample) using an ARES-G2® rotational rheometer (made commercially available by TA Instruments, New Castle, Del., USA) for a total of sixteen (16) yield stress measurements. The data for each Sample up to 100 $s^{-1}$ was fitted against the Herschel-Bulkley model (wherein a yield stress is calculated by conducting a sheer sweep of a detergent of from 0.01 $s^{-1}$ to 100 $s^{-1}$ using a standard 2× Ultra TIDE® liquid detergent made commercially available by The Procter & Gamble Company, Cincinnati, Ohio, USA) and an $R^2$ value was calculated.

The yield stress, $R^2$ values for each of the two tests from each of Samples A-H, as well as the average, the standard deviation and the relative standard deviation of the 16 measurements, are shown in Table 2.

TABLE 2

Yield Stress, R2, Standard Deviation, and % RSD for Samples A-H

| Sample | Yield Stress (Pa) | $R^2$ |
|---|---|---|
| A1 | 0.28167 | 0.9985 |
| A2 | 0.28653 | 0.9978 |
| B1 | 0.28508 | 0.9982 |
| B2 | 0.28047 | 0.9972 |
| C1 | 0.25573 | 0.9979 |
| C2 | 0.25330 | 0.9969 |
| D1 | 0.26276 | 0.9972 |
| D2 | 0.26988 | 0.9975 |
| E1 | 0.25895 | 0.9981 |
| E2 | 0.22829 | 0.9975 |
| F1 | 0.25742 | 0.9975 |
| F2 | 0.24318 | 0.9976 |
| G1 | 0.26075 | 0.9977 |
| G2 | 0.25956 | 0.9980 |
| H1 | 0.24234 | 0.9973 |
| H2 | 0.23631 | 0.9941 |
| Avg. | 0.26013875 | |
| SD | 0.01743473 | |
| % RSD | 6.70% | |

The $R^2$ value is indicative of how close the yield stress value is to the yield stress value calculated by the Herschel-Bulkley Model. An $R^2$ closer to 1 indicates the goodness of fit of the yield stress value to the mathematical model. The RSD of all of the measurements is indicative of how similar each of the measurements is to one another and here, demonstrates the homogeneity of the materials mixed throughout the container. An RSD of 10% or lower is considered acceptable by consumer. As is shown in by the results in Table 2, the $R^2$ for each of Samples A-H was close to 1, indicating that the yield stress from each Sample had a high goodness of fit to the yield stress calculated by the mathematical model. The RSD of 6.70% for the sixteen (16) measurements was below the 10% threshold, indicating that the sixteen (16) measurements taken throughout the container were all acceptable in similarity to one another and thus there was acceptable homogeneity and distribution of the structuring agent throughout the container. The data demonstrates that Applicant has successfully distributed a structuring agent throughout the entire container using the assembly and process of the present disclosure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container filling assembly for a fluid filling operation, the assembly comprising:

a temporary storage chamber enclosed by a temporary storage chamber housing having an inward facing temporary storage chamber housing inner surface;

a piston pump located at least partially within the temporary storage chamber, the piston pump comprising a piston pump shaft and a piston pump plate having a piston pump plate back surface, an opposing piston pump plate front surface, and a piston pump plate outer border extending from and connecting the piston pump plate back surface to the piston pump plate first surface, wherein the piston pump shaft is attached to the piston pump plate back surface and wherein the piston pump plate outer border is slideably movable about the temporary storage housing inner surface and wherein the piston pump comprises one or more seals surrounding the piston pump plate outer border such that the fluid composition cannot flow between the piston pump plate outer border and the temporary storage chamber housing inner surface;

a mixing chamber located upstream of the temporary storage chamber and a dispensing chamber located downstream of the temporary storage chamber; and a first valve connecting the mixing chamber to the temporary storage chamber and a second valve connecting the temporary storage chamber to the dispensing chamber, wherein the first valve is a three-way valve and wherein the piston pump controls a first rate of flow for transferring the fluid into the temporary storage container and a second rate of flow for transferring the fluid to the dispensing chamber and the first and second rates of flow are different.

2. The assembly according to claim 1, wherein the temporary storage chamber housing comprises a first wall, an opposing second wall, and side walls extending from and connecting the first wall to the second wall, wherein the piston pump plate front surface faces the second wall and wherein the piston pump is movable along an axis perpendicular to the second wall.

3. The assembly according to claim 2, wherein the axis intersects the second wall at an origin point and wherein the piston pump is movable along the axis among the origin point, a second point, and a third point, each of the second and third point independently located at a distance from the origin point, wherein the second point and the third point have a distance of greater than 0 mm.

4. The assembly according to claim 3, the temporary storage chamber having a maximum volume $V_2$ defined by when the piston pump is located at the third point along the axis and an adjusted volume $V_3$ defined by when the piston pump is located at the second point along the axis, wherein the adjusted volume $V_3$ is less than or equal to the maximum volume $V_2$.

5. The container filling assembly for a fluid filling operation of claim 4, wherein the assembly further comprises a mixer located at least partially within the mixing chamber.

6. The container filling assembly for a fluid filling operation of claim 5, wherein assembly further comprises a first material inlet valve and a second material inlet valve, both of which are in fluid communication with the mixing chamber.

7. The container filling assembly for a fluid filling operation of claim 1, wherein the first rate of flow is a rate of mixing.

8. The container filling assembly for a fluid filling operation of claim 1, wherein the second rate of flow is a rate of dispensing.

9. The container filling assembly for a fluid filling operation of claim 1, wherein the mixing chamber has a volume $V_1$, which corresponds to the total desired fluid for a filling cycle.

* * * * *